United States Patent [19]

Logan, Jr. et al.

[11] Patent Number: 4,540,208

[45] Date of Patent: Sep. 10, 1985

[54] POINT-OF-EGRESS CONTROL DEVICE FOR SAFELY SECURING EMERGENCY EXIT DOORS

[75] Inventors: Emanual L. Logan, Jr., Arlington, Va.; Walter M. Sommers; J. William Walsh, both of Baltimore, Md.

[73] Assignee: Reliable Security Systems, Inc., Cockeysville, Md.

[21] Appl. No.: 423,523

[22] Filed: Sep. 27, 1982

Related U.S. Application Data

[63] Continuation-in-part of Ser. No. 148,403, May 9, 1980, Pat. No. 4,354,699, and Ser. No. 263,955, May 15, 1981.

[51] Int. Cl.[3] ..... E05B 47/00

[52] U.S. Cl. ..... 292/341.19; 292/201; 292/92; 292/DIG. 51; 292/DIG. 60

[58] Field of Search ..... 292/163, 302, 304, 341.15, 292/341.19, DIG. 51, DIG. 53, DIG. 60

[56] References Cited

U.S. PATENT DOCUMENTS

| | | | |
|---|---|---|---|
| 148,662 | 3/1874 | Burr | 292/341.19 |
| 595,606 | 12/1897 | Crouch et al. | 292/341.19 X |
| 1,364,757 | 1/1921 | Herrman | 292/341.15 X |
| 2,917,335 | 12/1959 | Pyka | 292/DIG. 36 |

FOREIGN PATENT DOCUMENTS

| | | | |
|---|---|---|---|
| 1046552 | 1/1979 | Canada | 292/341.19 |

*Primary Examiner*—Richard E. Moore

*Attorney, Agent, or Firm*—Quaintance & Murphy

[57] ABSTRACT

Apparatus for securing an emergency exit door includes a bolt for engaging a keeper, a dogging mechanism for dogging the bolt and a fluid throttling device disposed between the bolt and dogging mechanism. An electrical timer is connected to the dogging mechanism by a solenoid and starts to count upon an attempt to open the door. After a predetermined time interval has run, the electrical timer releases the dogging mechanism and allows the door to open. If the electrical timer fails to release the dogging mechanism, the door will still open if pushed due to operation of the fluid throttling device, which slowly shortens under pressure, allowing the bolt to clear the keeper.

In order to readily align the keeper with the bolt, the keeper is loosely mounted and guided into alignment with the bolt by a bevelled guide. Upon being latched by the bolt, the keeper is held rigidly between the guide and the bolt.

5 Claims, 30 Drawing Figures

POINT-OF-EGRESS CONTROL DEVICE FOR SAFELY SECURING EMERGENCY EXIT DOORS

PARENT APPLICATIONS

This application is a continuation-in-part of Ser. No. 148,403, filed May 9, 1980 (now U.S. Pat. No. 4,354,699), in the name of Emanuel L. Logan, Jr., now allowed, and Ser. No. 263,955 filed May 15, 1981, in the names of Emanuel L. Logan, Jr., and James W. Walsh.

RELATED PATENT APPLICATIONS

"Emergency Exit Door Latching and Locking Apparatus", Ser. No. 22,110, filed Mar. 3, 1979 now allowed;

"Point-Of-Egress Control Device for Securing Exit Doors Safely", Ser. No. 929,968, filed Aug. 1, 1978, now U.S. Pat. No. 4,324,425;

"Magnetic Emergency Exit Door Lock System", Ser. No. 051,724, filed June 25, 1979, now U.S. Pat. No. 4,257,631; and "Timing Delay for Emergency Exit Doors", Ser. No. 125,995, filed Feb. 29, 1980, now U.S. Pat. No. 4,328,985.

"Timing Apparatus for Delaying Opening of Doors", Ser. No. 089,398, filed Aug. 10, 1979, now U.S. Pat. 4,314,722.

BACKGROUND OF THE INVENTION

1. Field of the Invention

The instant invention relates to emergency exit door security systems, and more particularly, the instant invention relates to emergency exit door security systems wherein the system includes a time dealy which delays opening of an emergency exit door for a predetermined interval, as long as there is no emergency condition. Upon the occurrence of an emergency condition, the door unlocks immediately.

2. Technical Considerations and Prior Art

As is set forth in the aforecited U.S. patent applications and issued patents, there is a need for a new type of emergency exit door lock or latch which delays opening of an emergency exit door. In these patent applications, delay is accomplished by either throttling a fluid white an attempt is being made to open the door; by initiating an electrical delay of a release mechanism after an attempt has been made to open the door, or by a combination of both the hydraulic and electrical delays. In each device disclosed in these patent applications, an emergency release is provided which allows the latches to release immediately upon the occurrence of an emergency situation. For example, the lathces are connected to smoke detectors and pull boxes which, when activated, permit the latches to bypass any restraint on their opening. Moreover, when there is an interruption of electric current to these latches, the latches will allow the doors to open when pushed.

In order to successfully commercialize the concepts disclosed in the aforecited patent applications, it was deemed advisable to simplify the latching mechanism so that the mechanism could be assembled from relatively inexpensive, stamped parts and from off-the-shelf, purchased parts. Moreover, the hydraulic circuits necessitated by utilizing solenoid-operated valves in conjunction with hydraulic cylinders made the arrangements disclosed in these patent applications expensive while compromising reliability. In a system which has both a hydraulic delay and electronic delay, the electronic delay should ideally be completely independent of the hydraulic delay. However, in the systems disclosed in the aforecited patent applications, the electronic delay functions within the hydraulic system by opening a valve which lets hydraulic fluid bypass a throttle. Thus the two systems are not completely independent which comprises the device's redundancy.

As is set forth in parent application Ser. No. 148,403, filed May 9, 1980, in the name of Emanuel L. Logan, Jr., under certain circumstances it may be desirable to divorce the unlatching structure of a door, such as an emergency exit door, from the delay structure, so that the delay structure can be retrofitted on existing doors which already have their own hardware. Such an approach is disclosed in U.S. Pat. No. 4,257,631 entitled "Magnetic Emergency Exit Door Lock With Delayed Opening" and in copending patent application Ser. No. 089,398, now U.S. Pat. No. 4,314,722, entitled "Timing Apparatus For Delaying Opening Of Doors". Both of these approaches have disadvantages which may forestall their use. With a magnetic arrangement, there is a problemm of "residual magnetism" which must be overcome in order to open a door even after the magnet is de-energized. In the door closure type of delay device, the door is never completely free of the door closure jamb, which can interfere with ordinary operation of the door when the door operates in a non-delay mode.

It is important to configure the latch mechanism so that the bolt does not jamb when force is applied against the door. Accordingly, there is a need for a delay apparatus which can be easily applied to emergency exit doors as a retrofit for existing installations or as an accessory for planned installations which also use conventional latching and locking hardware.

As is apparent from the above discussions, it is desirable to both improve the locking or latching mechanism from the standpoint of both reliability and cost, and it is desirable to provide a delay mechanism which both operates effectively and can be retrofitted to existing exit doors.

SUMMARY OF THE INVENTION

In view of the aforementioned considerations, it is an object of the instant invention to provide a new and improved delayed opening device for an emergency exit which is relatively inexpensive to manufacture, reliable, easy to install, can be retrofitted to existing doors and has readily selectable modes of operation.

In view of the aforementioned considerations, the instant invention contemplates apparatus for securing an emergency exit door, which apparatus includes a delay having a closure-operated latch bolt which extends between the door frame and the door wherein retraction of the latch bolt is retarded so as to delay opening of the door. Preferably, the delay includes independently redundant delay systems which insure opening of the door should one system fail.

In a preferred embodiment of the invention, the bolt is mounted on the door jamb to engage a keeper which is mounted on the door.

The instant invention further includes an adjustable keeper which is floatably mounted to accomodate inaccuracies of alignment with the bolt, but which locks up with the bolt.

In accordance with one mode of operation of the instant invention, the process is reversible in that continuous pressure must be applied to the door for a selected time period before the delay apparatus releases.

In accordance with another mode of operation of the instant invention, the process is irreversible in that once the time delay has been started by pressing against the door, continuous pressure is no longer necessary for the delay apparatus to release at the end of the selected time period.

In addition, the instant invention includes the concept of delaying relatching of the door for a time period after the door is shut, regardless of the time interval between opening the door and shutting the door. If the door is opened during this time period and shut again, the time period begins anew.

In order to utilize readily available line current in buildings which may only be wired for sixty-hertz, 120/240 volt line current, the instant invention includes a transformer to step down the voltage. A sixty-hertz signal from the transformer is then used to drive both a ten-second counter and a twelve-bit counter.

In order to insure that the position of the bolt is know at all times by the logic of the system, a magnet is mounted on the bolt and a Hall-Effect switch positioned adjacent to the bolt to monitor the movement and position of the bolt. Moreover, a reed switch may be used to monitor the condition of a solenoid which solenoid is de-energized to release a bolt.

DETAILED DESCRIPTION

Figure 1:
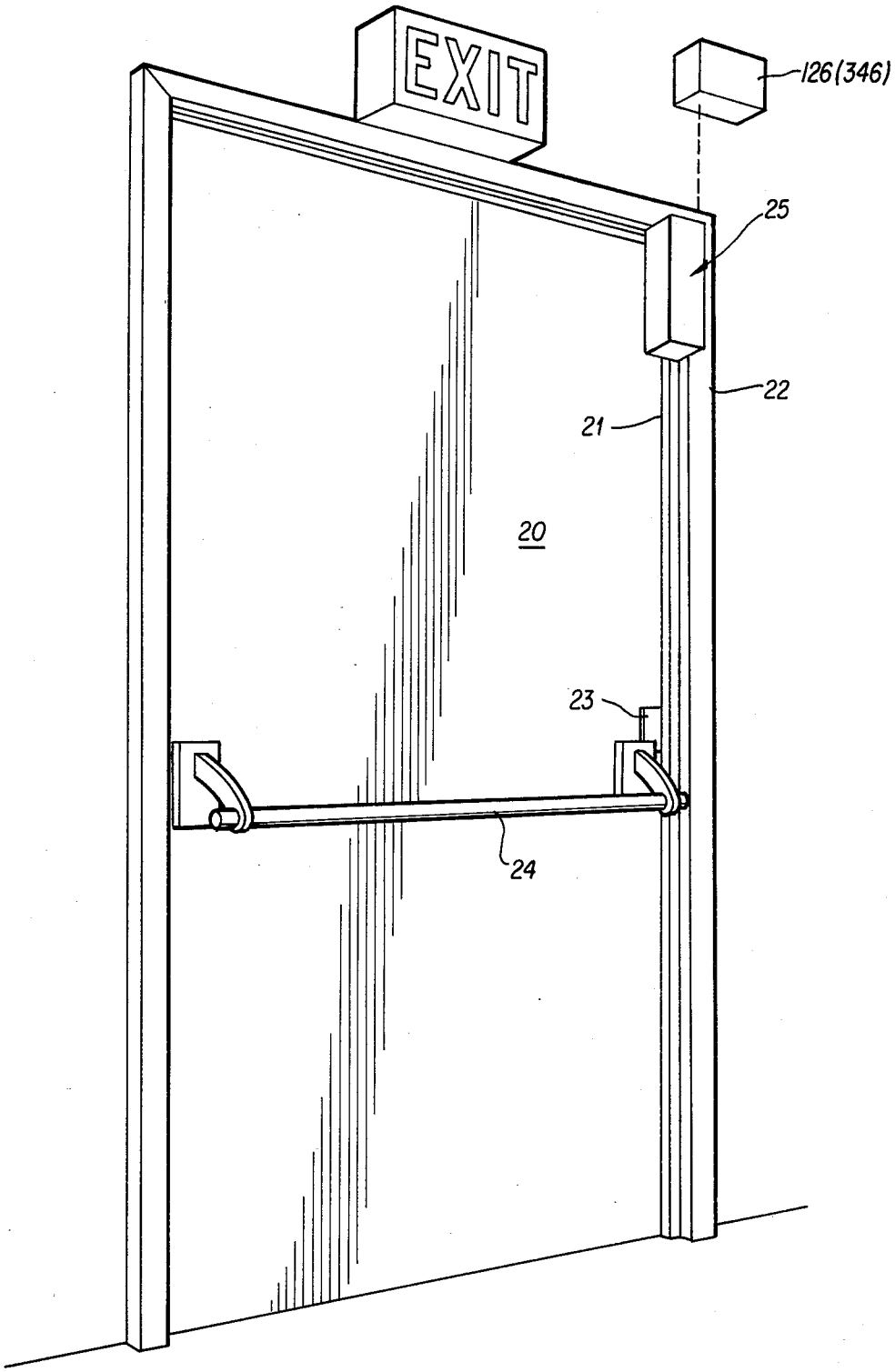
FIG. 1 is a perspective view of an emergency exit door having conventional panic bar hardware thereon and a retrofitted emergency exit latch with a delay feature to provide a delay apparatus in accordance with the instant invention.

Referring now to FIG. 1, there is shown an emergency exit door 20 which is hinged to close against a door jamb 21 of a door frame 22. The door 20 is equipped with a conventional panic latch 23, which is unlatched by a conventional panic bar 24. A delay apparatus, designated generally by the numeral 25, is secured to the door frame 22 in an upper corner thereof adjacent the free edge of the door 20. When the door 20 is opened, it pivots about its hinged edge so as to move away from the delay apparatus 25. While the delay apparatus 25 is shown mounted in the corner of the door frame 22, it could be mounted at any convenient location, such as along the vertical jamb so as to engage the free edge of the door.

(I) Electro-Mechanical Operation of Latch

Referring now to FIGS. 2 through 12 in general, there is shown a housing, designated generally by the numeral 26, which defines a base 27 and includes a slot 28 through which the strike portion 29 of a keeper, designated generally by the numeral 30, is passed in order to lock the door.

Preferably, the housing 26 is mounted on the door frame 22, and the keeper 30 is mounted on the door 20, so as to hold the door 20 against the door jamb 21 (also see FIG. 1).

The strike portion 29 of the keeper 30 includes a recess 31 and a strike 32 which cooperate with a bolt, designated generally by the numeral 33. The bolt 33 is a closure-operated swinging bolt which is pivoted on a pivot 34 that is secured to the base 27 of the housing 26. The bolt 32 includes a tooth 35 which projects into the recess 31 and an arm 37 on which is mounted a magnet 38 which cooperates with a Hall-Effect switch 39 to indicate when an attempt is made to open the door. Moreover, the arm 37 is engaged by the strike 32 upon closing the door to rotate the bolt to its latched position (as will be fully explained hereinafter).

Figure 3B:
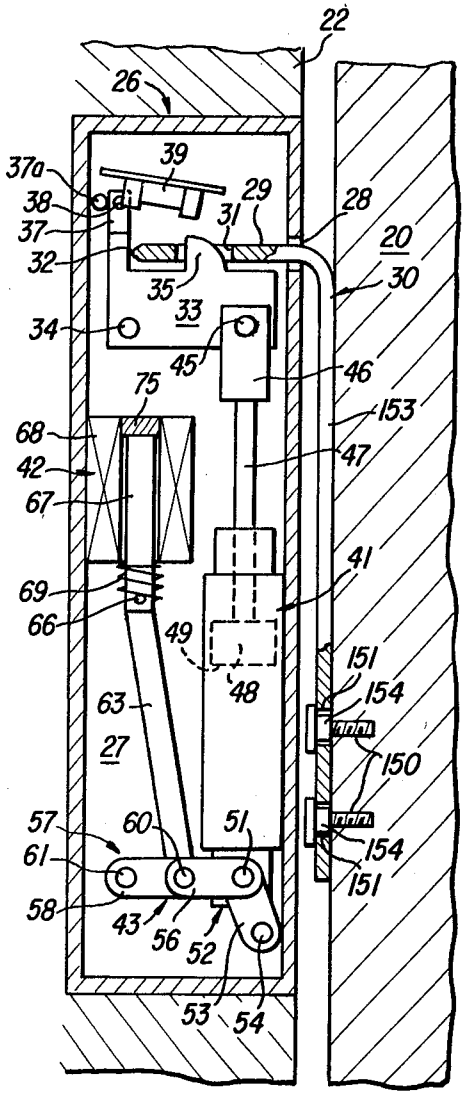
FIG. 3B is a side view, partially in cross-section, of the latch of FIG. 3A showing the latch in a latched or locked position.
Figure 3A:
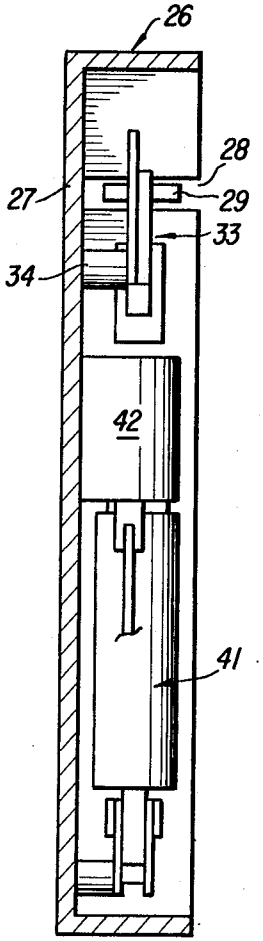
FIG. 3A is a rear view of a simplified configuration of the latch with portions cut away.
Figure 5:
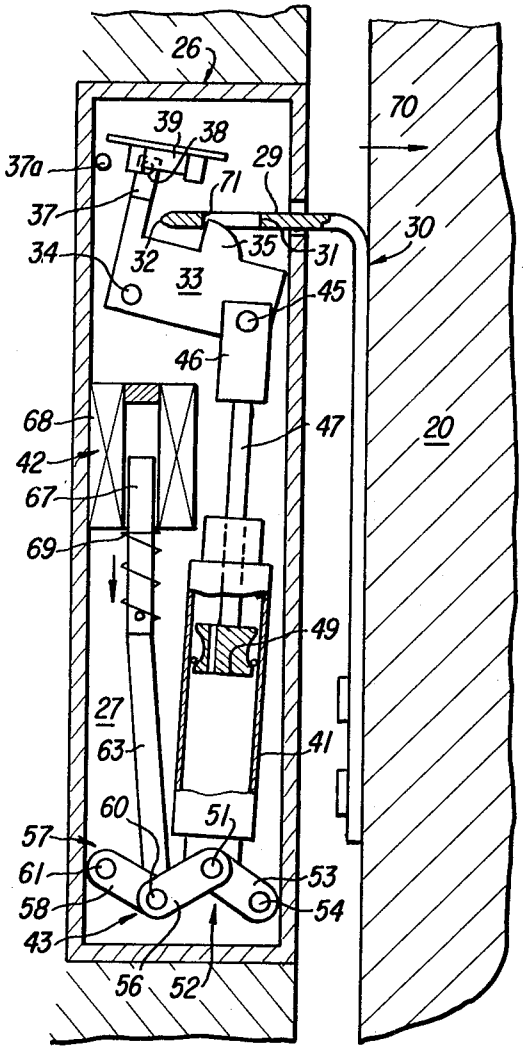
FIG. 5 is a view similar to FIG. 3, but showing the latch after a solenoid has released the toggle mechanism so that the door can open.
Figure 7:
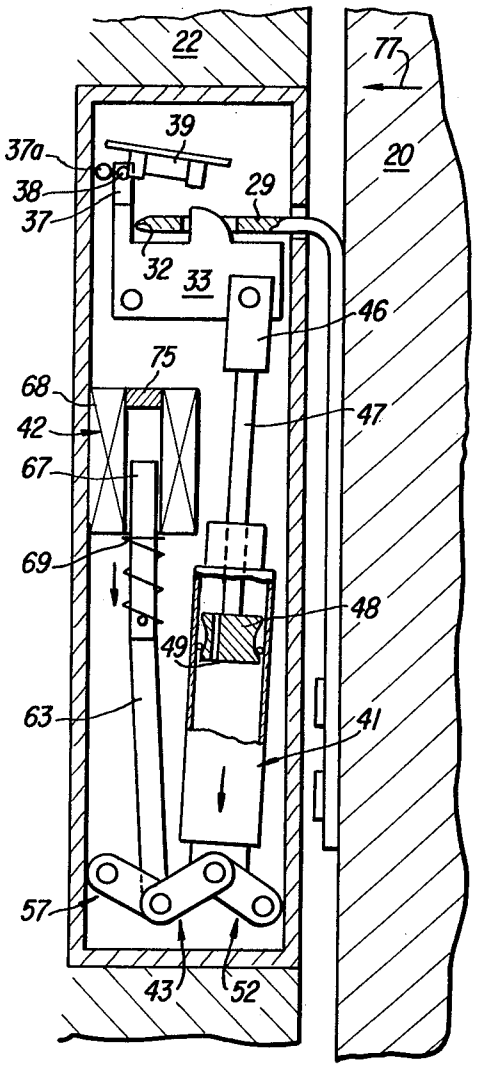
FIG. 7 is a view similar to FIG. 3, but showing the latch after the door has been shut.
Figure 6:
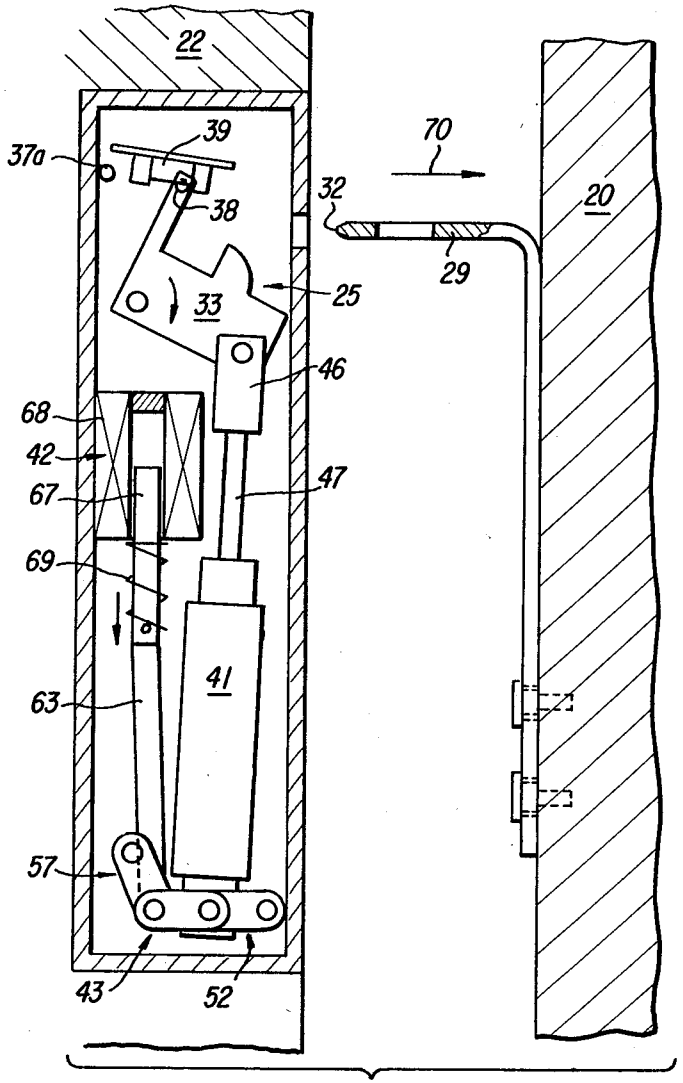
FIG. 6 is a view similar to FIGS. 3–6, but showing the door opened.

The bolt 33 is dogged in the position shown in FIG. 3 (also FIGS. 8 and 12) by a delay mechanism, which delay mechanism includes a hydraulic cylinder, designated generally by the numeral 41, and a solenoid, designated generally by the numeral 42, which solenoid is controlled by the circuitry of FIG. 13, as will be explained hereinafter. The hydraulic cylinder 41 is connected to the solenoid 42 through a double toggle linkage 43. As will be explained hereinafter, solenoid 42 either holds the toggle linkage 43, as shown in FIGS. 3, 4, and 8 through 10, or allows to be broken the toggle linkage, as is shown in FIGS. 5, 6 and 7. Even though the toggle linkage 43 appears to be in alignment the linkage is slightly below adjustment, for example approximately five degrees down.

As has been briefly explained in the "Background of the Invention", the instant invention utilizes a redundant delay system which includes throttling of the fluid in the hydraulic cylinder 41 and/or a timed release effected by de-energizing the solenoid 42. Preferably, the system will operate by de-energizing the solenoid 42, but if for some reason the electrical system fails and the solenoid is not de-energized, then a fluid is throttled in the hydraulic cylinder 41, and the door can still be opened after a period of time.

As has been amply explained in the related patent applications, the door 20 will release immediately upon an interruption of power to the solenoid 42. This interruption is caused by either an expiration of a time interval set by the circuit in FIG. 13 or the occurrence of an emergency condition detected by the circuit of FIG. 13. Either of these conditions allow the solenoid to permit collapse the toggle linkage 43.

Considering the latch delay mechanism 25 in more detail, the bolt 33 has through hole 44 therein which receives a pin 45 of a clevis 46. The clevis 46 is rigidly attached to a piston rod 47 that, in turn, is secured to a piston 48 within the hydraulic cylinder 41. The hydraulic cylinder 41 does not include a spring to project the piston rod 47 out of the cylinder. All flow of hydraulic fluid is contained within the cylinder 41.

The cylinder 41 is pivoted by a pin 51 to a first toggle link, designated by the numeral 52, of the double toggle linkage 43. The toggle link 52 includes a first link 53, which is pivoted by a pin 54 to the base 27, and a second link 56, also pivoted on pin 51. The link 56 forms a second toggle link, designated generally by the numeral 57, with a third link 58, which is pivoted to link 56 by a pin 60 at one end and to the base 27 by a pin 61 at the other end.

The second toggle link 57 is controlled by an actuator rod 63, which is pivotably mounted on the pin 60 at one end and pivoted at the other end by a cotter pin 66 to an armature 67 of the solenoid 42. The armature 67 is, in turn, positioned by either the coil 68 of the solenoid 42 or by a spring 69 which is overcome by applying current to the coil 68, so as to lock-up the armature in the coil.

Referring now to FIGS. 3 through 12 which show a complete cycle of the system upon using the solenoid 42 to release the system, when the door 20 is pushed in the direction of arrow 70 after the panic bar has been pushed (see FIG. 4) the striker 29 of the keeper 30 moves to the right, which causes surface 71 on the recess 31 the striker to engage the tooth 35 and to attempt to rotate the bolt 33 in the direction of arrow 72. Play in the hydraulic system allows the bolt 33 to drop whereupon motion of the bolt is arrested by the hydraulic fluid.

Figure 4:
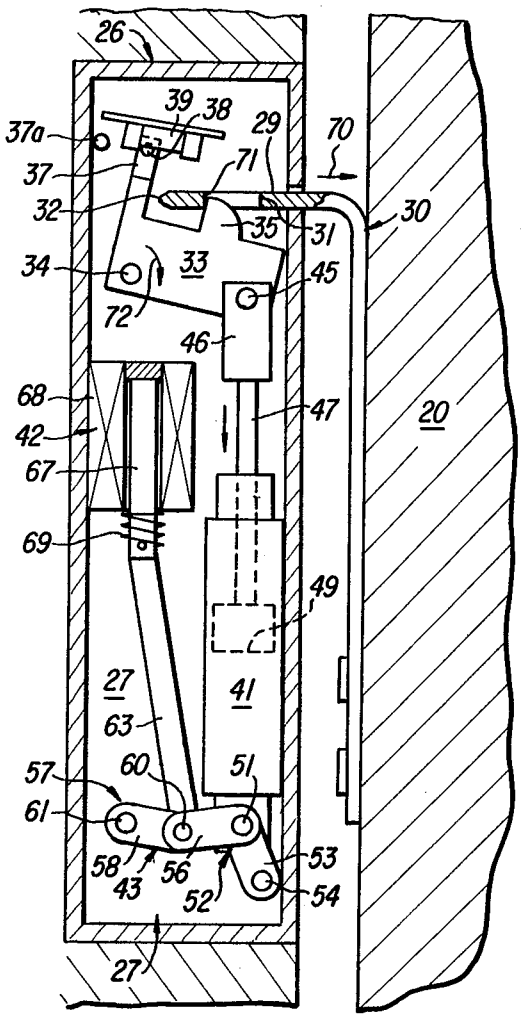
FIG. 4 is a view similar to FIG. 3, but showing the latch after an attempt has been made to open the door.

When the bolt 33 has rotated from the FIG. 3 to the FIG. 4 position, the magnet 38 on the arm 37 is moved to operate the Hall-Effect switch 39. This starts the timing circuitry of FIG. 13 or FIGS. 17, 18 or 21, which ever circuit is used. Preferably, the audible alarm does not start sounding for perhaps three to five seconds after the attempt to open the door has occurred, so that only serious attempts to open the door will be recognized. After the audible alarm sounds, the timing circuit runs for perhaps fifteen to thirty seconds, depending on its setting. In accordance with an irreversible mode of the invention, while the timing circuitry is running, the door can be returned from the FIG. 4 position to the FIG. 3 position, and the timing circuitry will continue to count. In accordance with a reversible mode of the invention, the count stops when one releases pressure on the door, and one must again push on the door to restart the count from the beginning. In any event, while the circuitry is counting, an alarm is ringing either over the door frame 22 or at a remote location (or both) indicating that someone is trying to open the door. After the count is finished, the timing circuitry cuts power to the coil 68, and the armature 67 moves from the FIG. 4 position to the FIG. 5 position under the bias of the coil spring 69. This causes the actuator rod 63 to push the second toggle link 57 overcenter from the approximately five degrees under center position of FIG. 4 to the collapsable position of FIG. 5. Until the toggle linkage 57 has been pushed to the collapsed position, any force on the bolt 33 due to pulling by the surface 71 on striker 29 on the tooth 35 is transmitted by the piston rod 47 and the hydraulic cylinder 41 to the toggle linkage 52, tending to collapse the toggle linkage 52 downwardly. This, of course, forces the actuator rod 63 downward also which is resisted by the attraction of the solenoid 42. However, once the solenoid 42 is deenergized, as is illustrated in FIG. 5, motion by the door 20 in the direction of arrow 70 causes the striker 29 to collapse the toggle linkage 57. The latch bolt 33 and first and second toggle links 52 and 57, which make up the double toggle linkage 43, then move to the FIG. 6 position in which the striker 29 is released and the door 20 can be opened. As will be explained further hereinafter and in accordance with one embodiment of the invention, power to the coil 68 remains off for perhaps ten seconds or so, so that the door 20 can continually be opened and shut for ten seconds after it has been initially opened. In accordance with a preferred embodiment, the door must remain shut for ten continuous seconds before it will relock. If the door is reopened within that ten-second period, the ten-second cycle restarts.

If an emergency situation occurs, then current to the coil 68 is interrupted, and the armature 67 is urged by the spring 69 to the position of FIG. 5, while the bolt 33 remains in the position of FIG. 3. Thereafter, when the door 20 is pushed so as to open the door, the bolt 33 will move continuously from the FIG. 3 position through the positions of FIGS. 4 and 5 to the position of FIG. 6, so as to allow the door 20 to open immediately.

Figure 8:
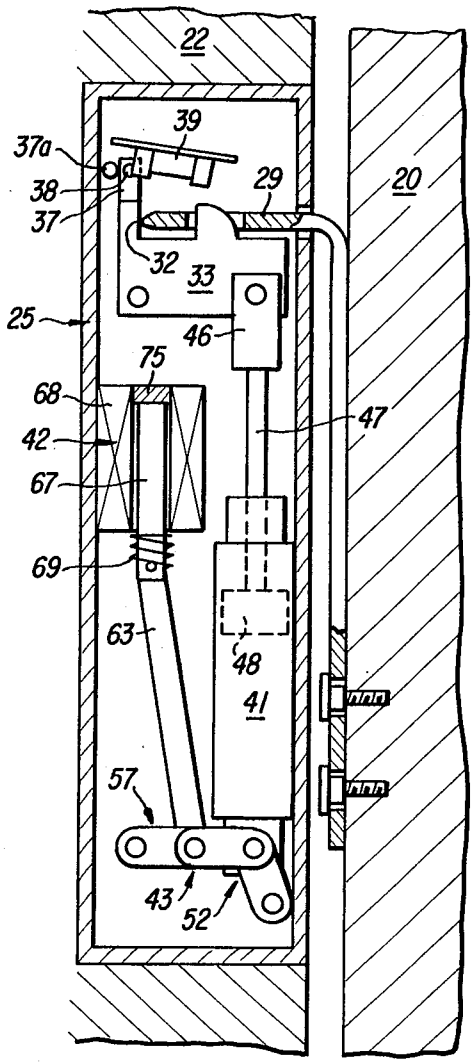
FIG. 8 is a view similar to FIG. 3 showing that the cycle is complete and that the door is now shut and latched with the armature of the solenoid drawn up.

Upon closing the door 20 by moving the door in the direction of arrow 77, the strike 32 on the striker 29 hits the arm 37 and rotates the arm 37 from the FIG. 6 position to the FIG. 7 position. However, as is readily seen, FIG. 7 is similar to FIG. 5, with the exception that the bolt 33 is pushed back against the stop 37*a*. Upon expiration of the ten continuous second interval, the coil 68 is energized which draws the armature 67 into the coil against the bias of spring 69. This pulls the second toggle link 57 to the position of FIG. 4 and holds the link 57 in this position due to the stopage of the armature 67 by the stop 75 (see FIG. 8). FIG. 8 is similar in configuration to FIG. 3.

While it is preferable that the system operate by cutting power to the coil 68, it is conceivable that the electronics might fail. It is also conceivable that the emergency interruption of power to the coil 68 of the solenoid 42 might not occur. As is seen in FIGS. 9 and 10, one can still open the door 20 by applying pressure thereto in the direction of the arrow 70.

Figure 9:
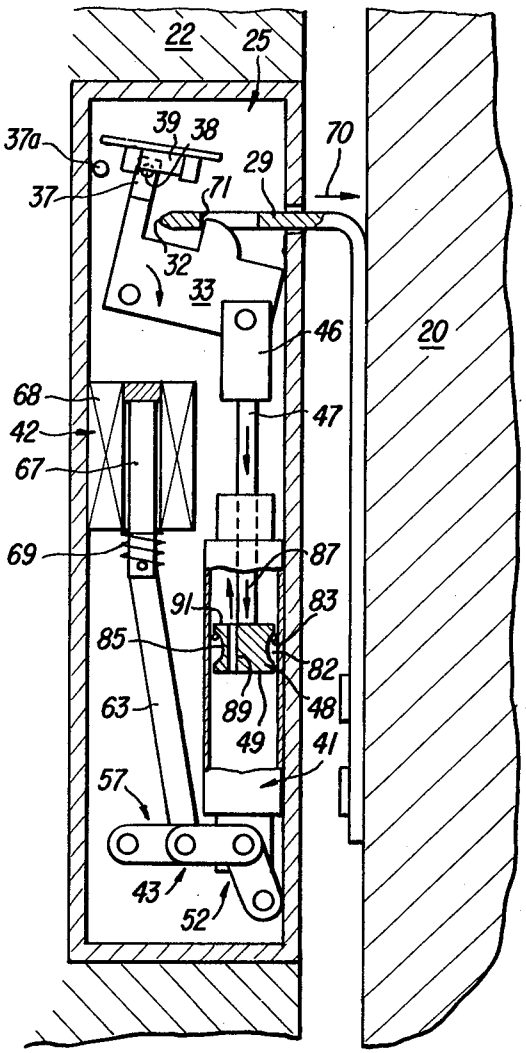
FIG. 9 is a view similar to FIG. 3, but showing operation of the hydraulic delay wherein the toggle mechanism is held jammed by the solenoid due to a malfunction of the solenoid.

As is seen in FIG. 9, if the solenoid 42 is energized, the second toggle linkage 57 cannot collapse. Accordingly, force applied by the surface 71 on the tooth 35 of the bolt 33 is transmitted by the piston rod 47 to the piston 48. The piston 48 is equipped with a floating piston ring seal 82 consisting of an O-ring 83 which seals between the piston 48 and the hydraulic cylinder 41 when a downward force is applied to the piston. As is seen in FIG. 10A, the valve 82 opens when the O-ring 83 is pushed downwardly by fluid pressure as shown in FIG. 10A by O-ring position 82'. This is due to the configuration of surface 85 on the side of the piston 48 and is a well known conventional structure for a one-way valve within a hydraulic cylinder.

Considering FIG. 9 specifically, the piston 48 moves downwardly in the direction of arrow 87 which forces the hydraulic fluid in the hydraulic cylinder 41 through a small orifice 89 in the piston 48 which throttles the fluid. Since the orifice 89 is small, it takes a considerable amount of time, perhaps fifteen to thirty seconds or so depending on the size of the orifice, viscosity of fluid and applied force, to move enough fluid from the first side 49 of the piston 48 to the second side 91 of the piston to allow the bolt 33 to move from the FIG. 9 position to the FIG. 10 position. In order to allow the piston rod 47 to retract into the cylinder 41 an air space 41*b* must be provided to absorb the increase in the height of the liquid 41*a* due to the addition of the piston rod volumn to the liquid volumn. During this time (because of a malfunction somehwere in the system), the solenoid 42 has remained energized. However, as is seen in FIG. 10, the door 20 has opened anyway even though the electronics of FIG. 13 have failed.

Figures 10, 10A, 11:
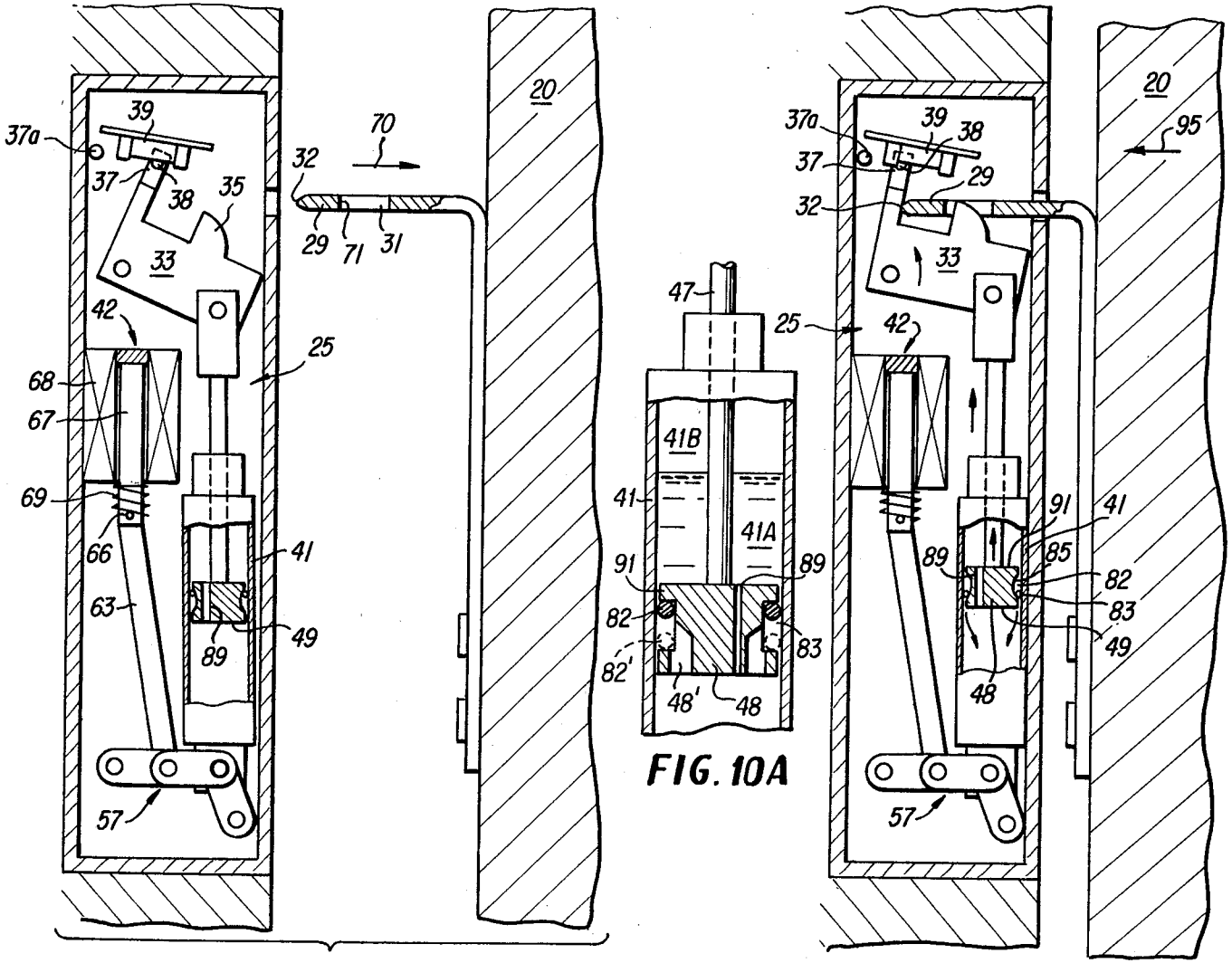
FIG. 10 is a view showing the door in an open position after having throttled sufficient fluid to allow the latch to release the keeper when the soldenoid has not released.
FIG. 11 shows the door closing while the solenoid is jammed and after the fluid has been throttled whereby force between a keeper on the door and a bolt in the latch returns a piston in the hydraulic throttling mechanism to the latched position.
Figure 12:
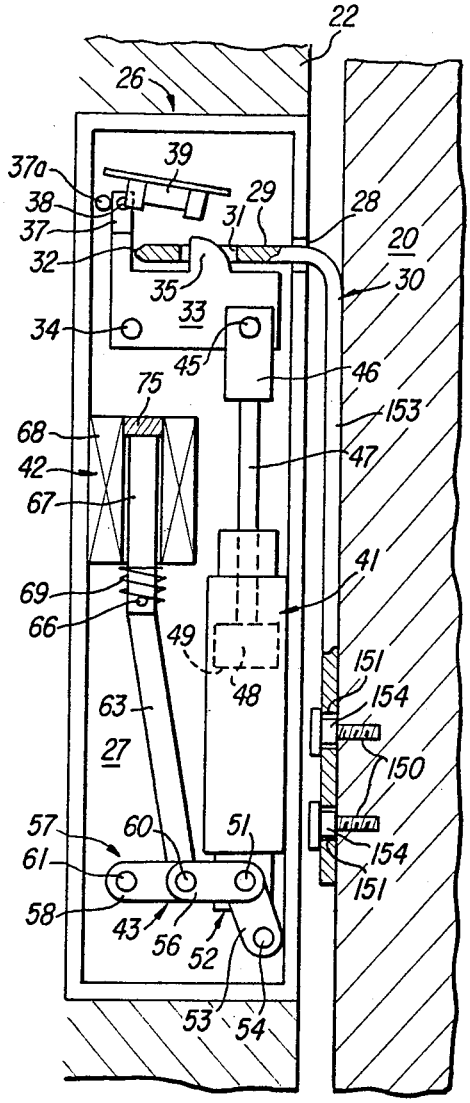
FIG. 12 shows the latching mechanism again latched as in FIG. 3.

Upon closing the door 20 by moving the door in the direcion of arrow 95 in FIG. 11, the strike surface 32 on the striker 29 of keeper 30 hits the arm 37 on the bolt 33 and rotates the bolt in the counterclockwise direction. This pulls the piston 48 back up from the FIG. 10 position toward the position of FIG. 12. As is seen in FIG. 10A, while this is happening, the one-way valve 82 allows the fluid to flow from past the side 91 of piston 48 through ports 48' of the piston to the space in the hydraulic cylinder adjacent to the side 49 of the piston. The bolt 33 is then returned to its locked position, as is seen in FIG. 12 (which is the same as FIGS. 3 and 8).

Figure 2A:
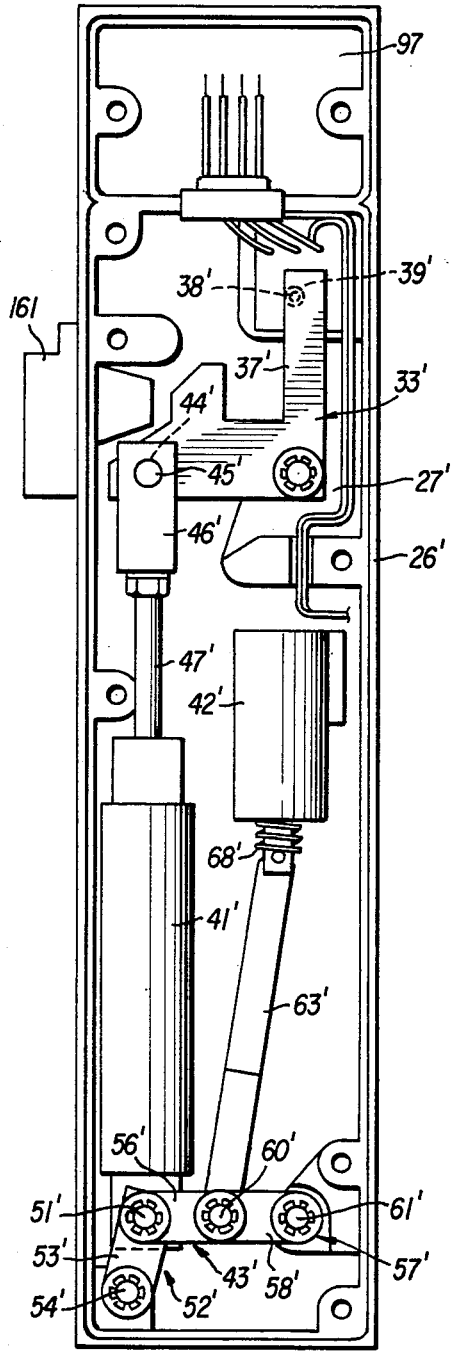
FIG. 2A is a side view of a commercial embodiment of the invention wherein the latch providing the delay apparatus is mounted on the right hand side of the door frame.
Figure 2B:
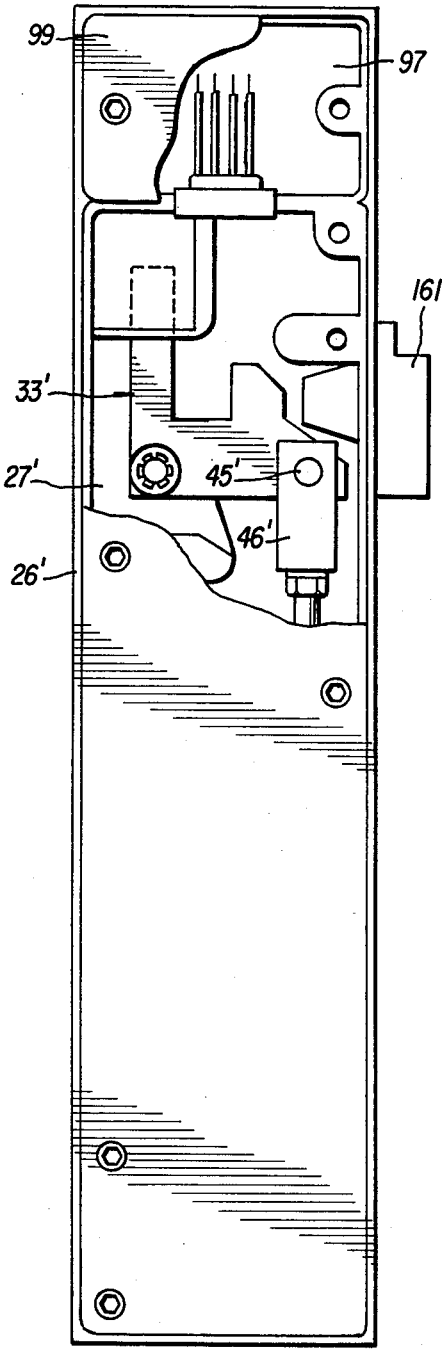
FIG. 2B is a side view of an embodiment of the invention wherein the same delay apparatus as shown in FIG. 2A is mounted on the left hand side of the door frame.
Figure 2C:
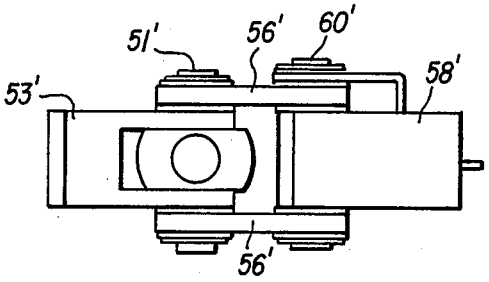
FIG. 2C is a bottom view of a portion of the latch providing delay apparatus shown in FIGS. 2A and 2B.

FIGS. 2A, 2B and 2C Commercial Configuration and "Unhandedness"

Referring now to FIGS. 2A, 2B and 2C, the particular commercial embodiment of the delay apparatus of the invention is shown in detail with parts similar to FIG. 3A—FIG. 13 being identified with primed numerals. As is apparent from FIGS. 2A and 2B, the delay apparatus is "unhanded". In other words, the delay apparatus can be mounted adjacent to either the upper right hand corner of the door 20, as is shown in FIG. 2A, or adjacent to the upper left hand corner of the door, as is shown in FIG. 2B. The only adjustment necessary is to position the removable cover plate 96 on the outside, exposed surface of the housing 26 after the appropriate wiring connections have been made in the space 97, which space is selectively openable on both sides. The open side of the space 97 which faces the door frame 22 (see FIG. 1) is covered by the door frame itself and receives leads projecting from the door frame in order to establish connections with leads 99 from the electrical components directly associated with the latching apparatus, such as the solenoid 42 and Hall-Effect switch 39.

(II) General Operation of Circuitry

Figure 13:
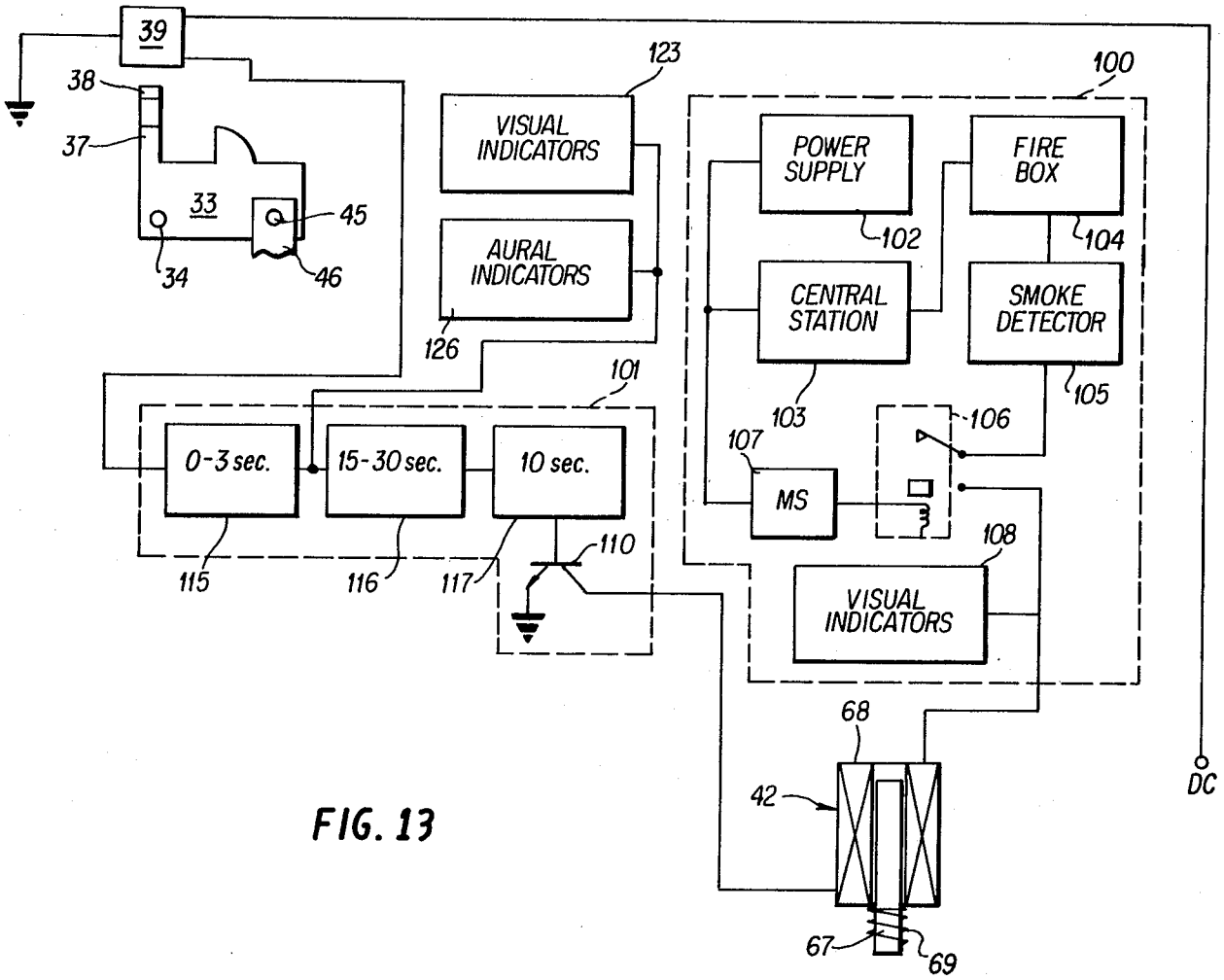
FIG. 13 is a schematic view showing an electronic timing circuit which releases the solenoid after a predetermined time interval upon an attempt to open the door and shows emergency condition detection circuitry for de-energizing the solenoid upon the occurrence of an emergency situation whereby the emergency exit door can open immediately.

Referring now to FIG. 13 where a general arrangement for the control of the solenoid 42 is shown (which arrangement was used with prior embodiment of the invention such as those disclosed in U.S. Pat. Nos. 4,328,985 and 4,354,699), the coil 68 of the solenoid is connected at one end to an emergency situation control circuit 100 and at the other end to a timing circuit 101. When energized, the coil retains the latch 25 in the latched mode by drawing the armature 67 up into the solenoid, as is seen in FIGS. 3, 8 and 12. The emergency situation circuit 100 includes a power supply 102, and optionally a central station control panel 103 (which preferably includes switches for de-energizing the solenoid remotely), fire boxes 104, and smoke detectors 105. These elements are connected in series with a dropout relay 106, which includes a manual reset switch 107. If either the fire boxes 104 or the smoke detector 105 indicate an emergency condition, the dropout relay 106 will be opened to cut off power from the power supply 102 to the coil 68 of the solenoid 42. Accordingly, the door 20 will unlock immediately if an emergency condition is sensed or if, for any reason, power to the solenoid 42 is interrupted.

The manual reset switch 107, which can be located at the central station 103, must be operated in order to reclose the dropout relay 106. If an emergency condition persists, then the manual reset 107 cannot reset dropout relay 106. A visual indicator 108, in the form of a light, is provided at the central station 103 and perhaps adjacent to the door 20, so as to indicate whether the door is operating in an emergency mode or a delay mode. The coil 68 of the solenoid 42 is attached to ground through the emitter of a transistor 110 located in timing circuit 101. Normally, the transistor 110 is switched on so as to conduct power from power supply 102 to ground. However, when the transistor 110 is switched off, the coil 68 of the solenoid 42 is no longer energized because it is in effect released by the transistor allowing armature 67 to be urged outwardly by the spring 69.

The timing circuitry 101 includes a zero to five-second timer 115, which is preferably set at three seconds; a fifteen to thirty-second timer 116, which is preferably factory set; and a ten-second timer 117, which is triggered by the timer 116 to turn off transistor 110 for a period of ten seconds. The timers operate in series and are connected to the Hall-Effect switch 39 positioned adjacent to the bolt 33 so as to be activated upon movement of the magnet 38 in juxtaposition with the Hall-Effect switch 39. Upon pushing the door 20 toward the open position, the bolt 33 is cammed from the FIG. 3 to the FIG. 4 position by the striker 29, whereupon the Hall-Effect switch 39 operates which starts the three-second timer 115 and which also lights visual indicators 125 which may be at the central station 103 or perhaps at the door 20. The three second timer 115 also energizes an audio indicator or alarm 126 located adjacent to the door 20, so as to indicate to the person trying to open the door and others in the vicinity that an attempt to exercise the door has occured. Upon operating the Hall-Effect switch 39, the first timer 115 is started and counts the time interval with a duration of three seconds.

If the door is released before the three to five-second interval expires, then the timer 115 is reset and will start all over again if the door is thereafter pushed. If the door is continually pressed for the three to five seconds, then the first timer 115 triggers the second timer 116 which runs for a period of fifteen to thirty seconds, the period being determined at the factory or during installation. In accordance with one embodiment of the invention, the timer 116 cannot be stopped or reset after being started. In other words, the operation is irreversable. Upon expiration of the time interval set by the timer 116 (preferably fifteen to thirty seconds), the second timer 116 generates a release signal which triggers the third timer 117. The third timer 117 interrupts power to the base of transistor 110 for an interval of ten seconds. While the transistor 110 is turned off, solenoid 42 will be de-energized and the armature 67 will project due to urging of the spring 69, thereby allowing the door to be opened immediately.

(III) Preferred Embodiment of the Keeper

In accordance with an initial embodiment of the invention, shown in FIGS. 2–12, the keeper 30 is made of spring steel and is secured to the door 20 by shoulder bolts 150. The shoulder bolts 150 are received in apertures 151 in an extended arm 153 of the keeper 30. The apertures 151 are larger than shoulders 154 on the shoulder bolts 150 so that the keeper is self-adjusting. Preferably, the shoulder bolts 150 hold the arm 153 in close fitting engagement with the surface of the door 20. Since the arm 153 is resilient, it will absorb forces applied to the door tending to open the door so as to act as a shock absorber and protect the lock mechanism in the housing 26.

Figure 14:
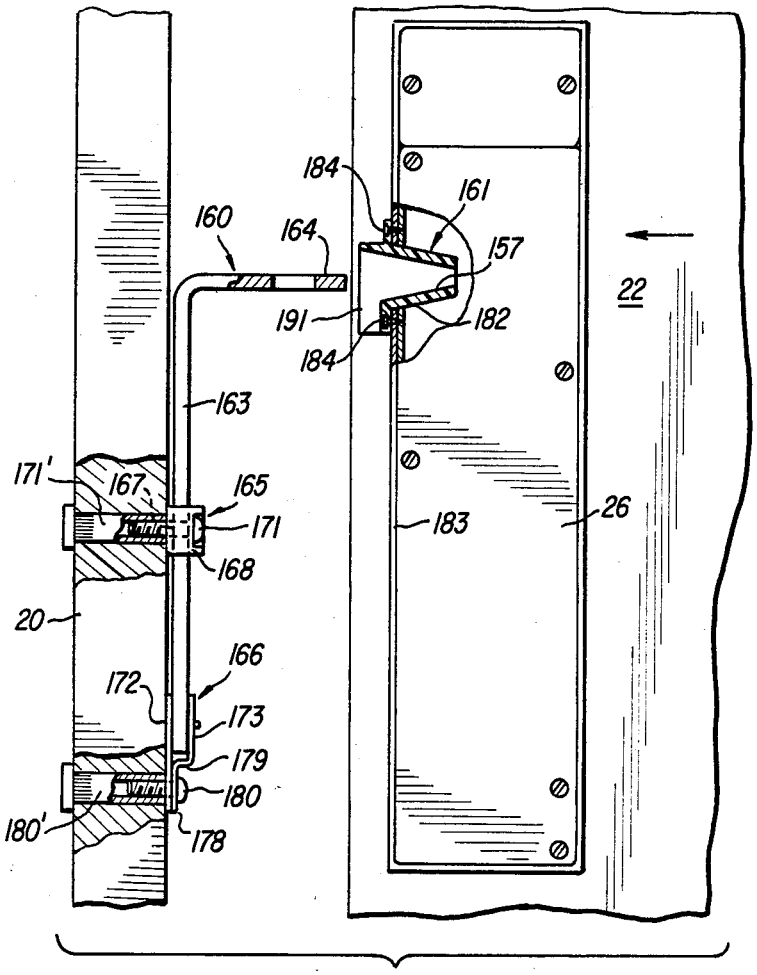
FIG. 14 is a side view showing a second embodiment (which is preferred) of a keeper mounting arrangement and keeper guide in accordance with the instant invention.
Figure 15:
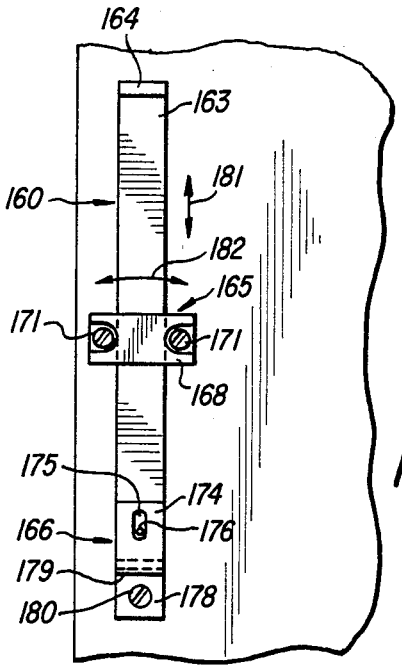
FIG. 15 is a front view of the keeper assembly shown in FIG. 14.
Figure 16:
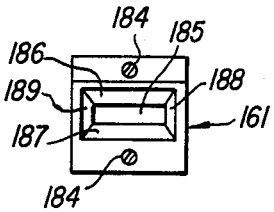
FIG. 16 is a front view of the guide recepticle shown in FIG. 14.

In accordance with a now preferred embodiment of the keeper, as shown in FIGS. 14, 15 and 16.

In FIGS. 14, 15 and 16, a keeper, designated generally by the numeral 160, and a keeper guide or recepticle, designated generally by the numeral 161, which guides the keeper into the housing 26. As is seen in FIGS. 15 and 16, the keeper 160 is L-shaped having a mounting shank 163 and a strike portion 164. The mounting shank 163 is retained by first and second brackets, designated generally by numerals 165 and 166, respectively. The bracket 165 includes a base plate 167 and a clamp plate 168 which fits over the base plate 167 and restrains the shank 163 midway between the ends of the shank. Both the base plate 167 and clamp plate 168 are held in place by screws 171 which pass through the clamp plate, through the base plate and into sexnuts 171′ installed from the opposite surface of the door 20.

The bracket 166 includes a base portion 172 and a stepped clamping portion 173. The stepped clamping portion 173 has a first flange 174 that has a slot 175 therein, which slot receives a pin 176. As is seen in FIG. 15, the pin 176 is substantially smaller in cross-section than the width or height of the slot 175 so as to accommodate limited motion of the mounting shank 163. The stepped clamping portion 173 also has a screw flange portion 178 which is joined to the flange 174 by step 179. The screw flange 178 is secured over the base 172 by a screw 180 which passes through the screw flange 178, through the base 172 and into a sexnut 80′ installed from the opposite surface of the door 20.

Since there is play between the shank 163 and the first and second brackets 165 and 166, the keeper 160 is free to move not only longitudinally in the direction of arrow 181 but also laterally in the direction of arrow 182. Accordingly, the keeper 160 can adjust with respect to the latch bolt 33 (see FIGS. 2–12) which latch bolt is inside of the case 26.

In order to properly guide the projection portion 164 of the keeper 160, the case is equipped with the guide 161 which is configured as a recepticle. The guide 161 is positioned within an opening 182 through sidewall 183 of the casing 26. The guide 161 is secured to wall 183 by a pair of mounting screws 184 and has an opening 185 therethrough which is surrounded by top and bottom beveled walls 186 and 187, respectively, and first and second beveled side walls 188 and 189, respectively. The side and top beveled walls 188, 189 and 186 project out beyond the wall 183 by a distance considerably greater than projection of the bottom wall 187 beyond the wall 186 in order to define a slot 191, which slot accommodates the shank portion 163 of the keeper 160.

While the door 20 is being shut, the beveled walls 186–189 cam the keeper portion 164 of the keeper 160 into the opening 185 so that the keeper 160 will align with the bolt 33 inside the housing 26 (see also FIGS. 2–11). The play provided by the loose mounting arrangement between the brackets 165 and 166 and shank 163 allows the position of the keeper 160 to be adjusted by the beveled surfaces 185–189 so that the keeper will be properly aligned.

(IV) Detailed Descriptions of Reversible Mode Control Circuits

FIGS. 17A, 17B, 18A, 18B 19, and 20 disclose details of one embodiment that the block diagram circuitry of FIG. 13 may assume and includes departures in design and function from what is disclosed in FIG. 13. The circuitry of FIGS. 17 and 18 discloses a reversible mode of operation wherein time delay counters are reset when the opening pressure on the door ceases.

Figure 17A:
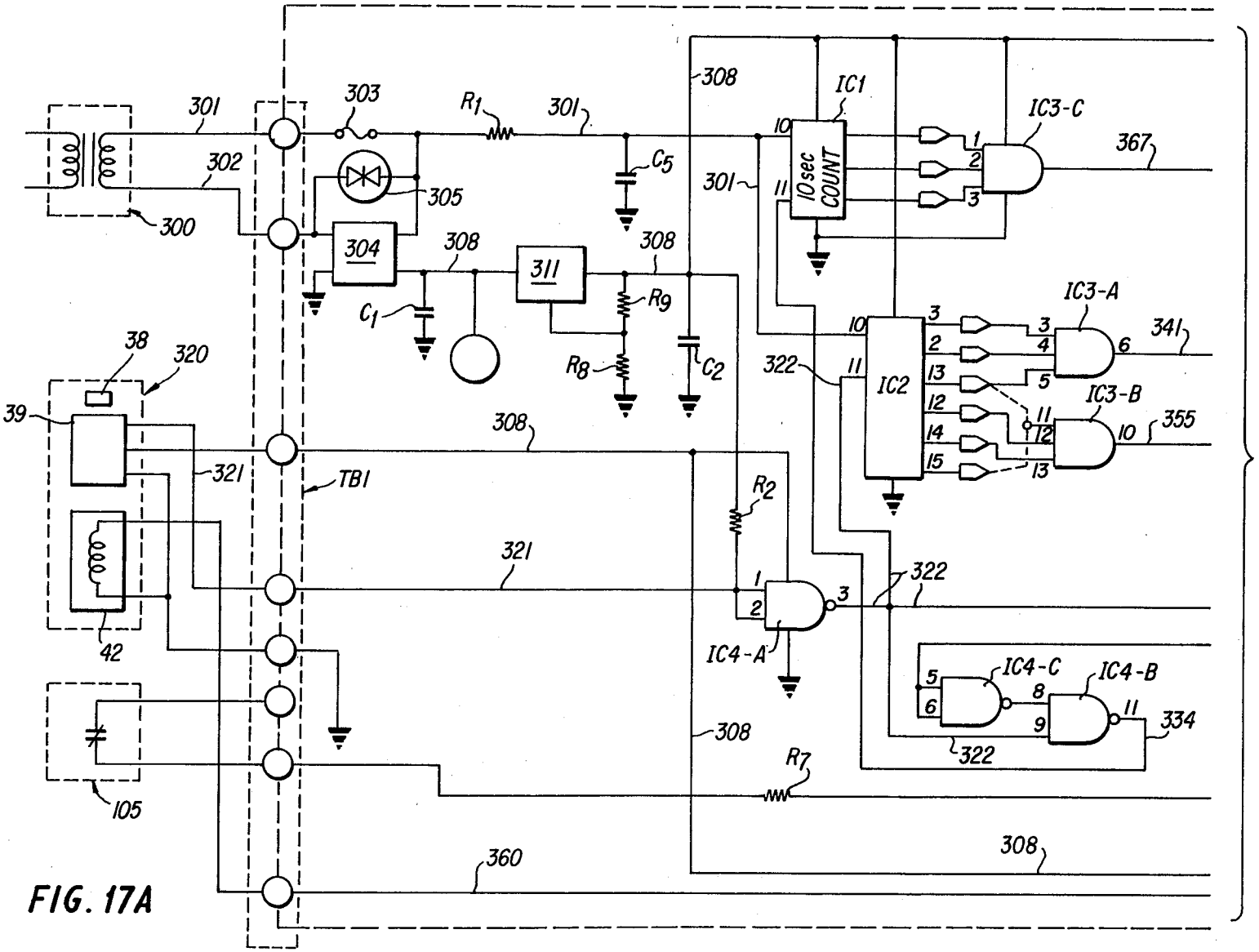
FIGS. 17A and 17B are circuit diagrams of a single circuit showing the details of one embodiment of the circuitry shown generally in FIG. 13 wherein the system operates in a reversible mode.
Figure 17B:
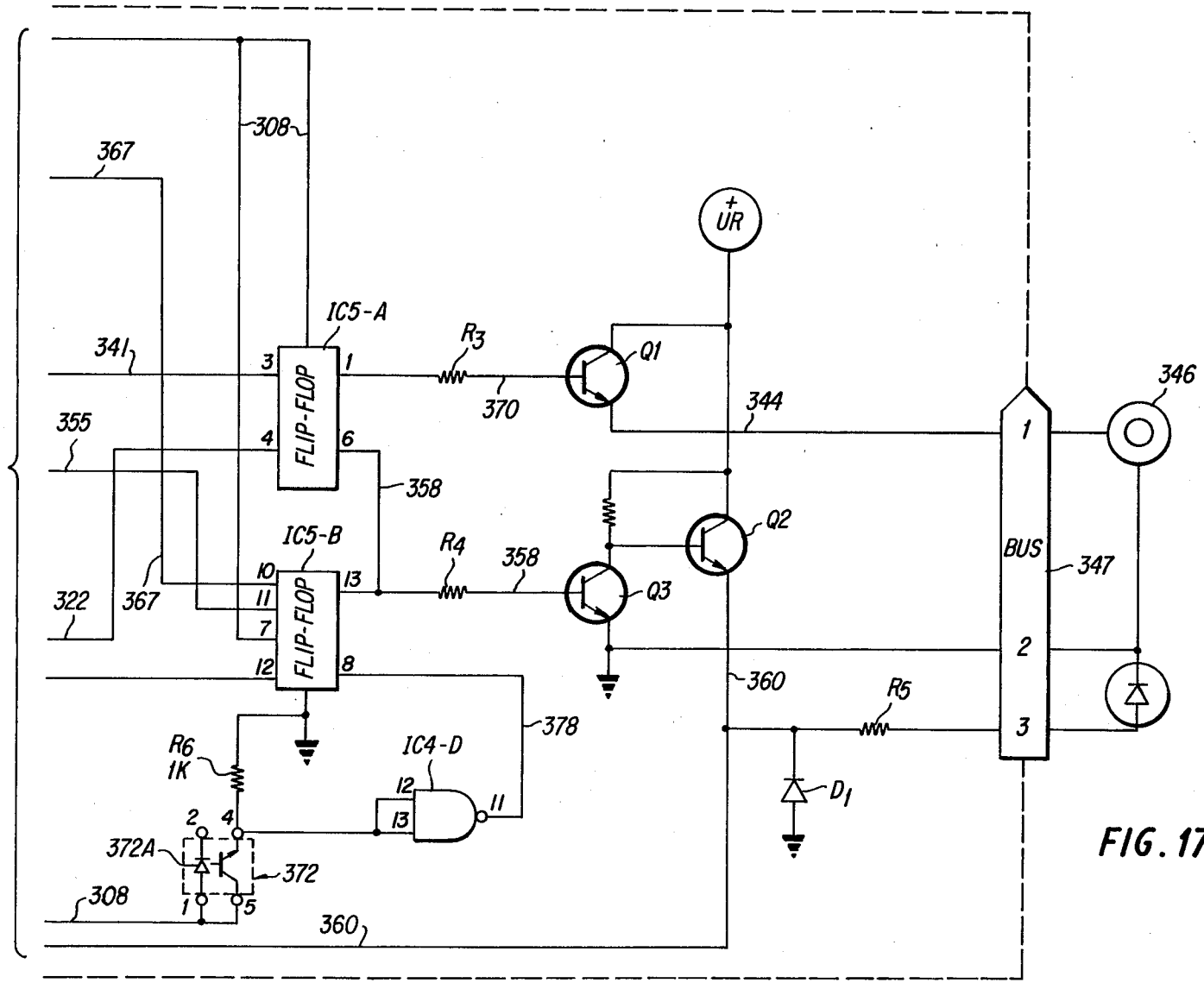

Referring now to FIGS. 17A and 17B, wherein a single door control system is disclosed, a transformer 300 converts regular 60-cycle, 220/240 or 110/115 volt line current to 14 volt, 1.00 amp, 60-cycle current. The 60 hertz output from transformer 300 is applied over line 301 to terminal block TB1 through a three-ampere fuse 303 and is applied over line 302 to a bridge rectifier 304, which bridge rectifier converts the AC supply current to DC. An MOV 305 is connected across the bridge rectifier 304 to prevent voltage surges in excess of 56 volts peak-to-peak from passing through into the rest of the circuitry by shunting the transformer output or blowing the fuse 303 upon the occurrence of such a surge. The DC output from bridge rectifier 304 is applied over line 308 where it is filtered by a capacitor C1 to a voltage regulator 311 that controls the input voltage to the logic circuitry. Resistors R9 and R8 serve as voltage dividers which set the voltage output from regulator 311 at a specific voltage level suitable for the logic circuitry. Capacitors C2 and C3 further filter the output from voltage regulator 311.

The 60-cycle AC signal on line 301 is applied to input pins 10 of a ten-second counter IC1 and a twelve-bit counter IC2 in order to provide these counters with a driving pulse.

Before describing the logic circuitry components in detail, it is necessary to briefly describe the inputs from the lock itself, which is designated generally by the numeral 320. In accordance with the preferred embodiment, the output of the Hall-Effect switch 39 over line 321 goes low upon moving the magnet 38 (preferably a rare earth magnet, such as a Summarian Cobalt magnet) relative to the Hall-Effect switch upon closing the door. The low on line 321 applies a low to both pins 1 and 2 of inverting AND gate IC4-A which produces a high output on pin 3 out over line 322. The high on pin 3 locks the 12-bit counter IC2 in a reset mode. The output over line 322 is also applied to pin 4 of flip-flop IC5-A and to pin 9 of inverting AND gate IC4-B which results in a high on output pin 10 of the gate IC4-B, the output of which is applied over line 334 to pin 11 of a 10-second counter IC1. The high on line 334 holds the 10-second counter IC1 in a reset mode.

When the magnet 38 is moved or repositioned with respect to the Hall-Effect switch 39 upon opening the door, a high signal is applied to pins 1 and 2 of IC4-A. This produces a low output on line 322, which low is applied to pin 11 of 12-bit counter IC2 and starts the count. Counter IC2 is programmed for initiating the start of the 3-second nuisance time interval or the 15 or 30-second time delay before allowing the bolt 33 to be released by solenoid 42 (also see FIGS. 3–13).

The AC signal from the transformer 300 applied over line 301 is applied to pin 10 of the ten-second counter IC1. The signal on line 301 is a 60-hertz signal which the ten-second counter IC1 divides. The ten-second counter IC1 will count approximately 600 cycles before resetting. Normally, in order to provide an output at three seconds, 180 cycles would be counted, but since there are only three gates available, approximately 180 cycles is the maximum resolution and therefore the output occurs at 2.93 seconds instead of three seconds. To enable the use of a three input AND gate the count is set a 176. At 2.93 seconds, pins 3, 2 and 13 of twelve-bit counter IC2 provide an output to AND gate IC3-A, which gives a high output from pin 6 which is applied over line 341 to pin 3 of flip-flop IC5A (FIG. 17B).

Flip-flop IC5A then provides a high output on pin 1 which is applied through a 10K resistor R3 to transistor Q1. The emitter of transistor Q1 applies a voltage over line 344 to a door horn 346 via junction 1 of a connector 347. Accordingly, the horn 346 which is equivalent an aural indicator of FIG. 13, sounds if the door is pressed against for three seconds, so as to displace the magnet 38 with respect to the Hall-Effect switch 39 for a period of three seconds.

The three-second delay before sounding the horn 346 allows the system to discriminate between a serious attempt to open the emergency exit door and a nuisance. The signal applied to pin 10 of ten-second counter IC1 and pin 10 of twelve-bit counter IC2 continues the count in IC2 for generating an output on pins 13, 12 and 14 in order to de-energize the solenoid 42 to release the bolt 33 and allow the door to open. If a 30-second delay is desired, rather than a 15-second delay, then pin 15 of IC2 is connected to AND gate IC3B instead of pin 13.

The release signal from AND gate IC3-B is transmitted to de-energize solenoids 42 by placing a high on the pin 10 which is transmitted over the line 355 to pin 11 of flip-flop IC5-B. The output on pin 10 of flip-flop IC5B is applied over line 358 to turn on transistor Q3, which in turn switches off a power transistor Q2 that is connected to the solenoid 42 by line 360. When power is cut to the solenoid 42 by turning off power transistor Q2, the solenoid allows the toggle linkage holding the bolt 33 in a projected position to collapse so that the door will open.

When the door is shut after being opened, the magnet 38 is again aligned with Hall-Effect switch 39. This causes a low output by the Hall-Effect switch 39 to be applied over line 321, and this low is applied to pin 1 and 2 of AND gate IC4-A. This causes pin 3 on AND gate IC4-A to go high, putting a high on line 322, which high is applied to pin 11 of twleve-bit counter IC2 to reset IC2. In addition, the high on line 322 is applied to pin 4 of flip-flop IC5-A in order to reset the flip-flop. Moreover, the high on line 322 is applied to pin 9 of AND gate IC4-B, which also has a high on pin 8 due to a signal from AND gate IC4-C which has been pulsed by a low from pin 12 of flip-flop IC5-B.

The low on output pin 10 of AND gate IC4-B is applied over line 334 to pin 11 of ten-second counter IC1, which low releases the ten-second counter from the AC line 301 applied to pin 10 of the 10-second counter. The input signal on pin 11 of ten-second counter IC1 causes the counter to begin counting a 10-second time period. when the 10-second time period is detected by pins 1, 2 and 3 of inverting AND gate IC3-C, a high output occurs at pin 9 of IC3-C which is applied over line 367 to pin 10 of the flip-flop IC5B to reset the flip-flop. When the flip-flop IC5B is reset, pin 13 will go low and transistor Q3 will go low to turn on power transistor Q2. When power transistor Q2 is turned on, current will pass through line 360 and energize the solenoid 42 so as to relock the door.

In addition, as pin 13 of flip-flop IC5-B goes low, a low is applied to pin 6 of flip-flop IC5A, which is in the set condition, while a high is applied to pin 4 of flip-flop IC5A from line 322, which is a reset. At this point, the flip-flop IC5A resets causing pin 1 to go low and apply a low over line 370 to the base of transistor Q1, switching the transistor off and cutting current to line 344 which turns off the horn 346.

If the door is shut and the lock is closed, the central alarm or smoke detector 105 has contacts 105-A therein which, when opened, causes an optical transistor 372 to have a low output on pin 4 which applies a low to pins 12 and 13 of AND gate IC4-D (FIG. 17B). This causes AND gate IC4-D to have a high output on pin 11, which high output is applied over line 378 to pin 8 of flip-flop IC5-B to set the flip-flop. Upon setting the flip-flop IC5-B, pin 13 goes high and a high is applied to transistor Q3 and to pin 6 of flip-flop IC5-A. This in turn causes pin 1 of flip-flop IC5-A to go high and turn on trasistor Q1.

When Q1 is turned on, the horn or alarm 346 is energized and sounded. Since pin 13 of IC5B is high, transistor Q3 is turned on which grounds power transistor Q2 thereby turning off power transistor Q2 and releasing solenoid 42 by cutting current to line 360. Consequently, the solenoid 42 collapses the linkage 57 allowing the bolt 33 to open upon pressure being placed against the door 20 so as to pull keeper 29 from the bolt 33.

In addition, as pin 13 goes low, a low is applied to pin 6 of flip-flop IC5-A, which is in the set condition, while a high is applied to pin 4 of flip-flop IC5-A from line 322, which is a reset. At this point, the flip-flop IC5-A resets causing pin 1 to go low and apply a low over line 370 to the base of transistor Q1, switching the transistor off and cutting current to line 344 which turns off the horn 346.

In order to facilitate testing or to compensate for false alarm, as soon as the contacts 105-A in the smoke detector 105 close, a low is placed on line 371 connected to pin 2 of the opto isolator 372 (FIG. 17B) which causes the infrared diode 372A in the transistor to glow turning on the transistor. This places a high on pin 4 of the transistor and a high on pins 12 and 13 of AND gate IC4-D. Pin 11 of AND gate IC4 then goes low applying a low signal over line 378 to pin 8 of flip-flop IC5-B which sets the flip-flop. When the flip-flop IC5-B is set, the horn 346 ceases sounding and the solenoid 42 is re-energized. Pin 12 of the flip-flop IC5-B was low so that the pins 5 and 6 of AND gate IC4-C, by virtue of having a low thereon, produce a high at pin 4 of AND gate IC4-C and input pin 8 of AND gate IC4-B.

The high at pin 9 of AND gate IC4-B is already high due to the lock being in its original reset condition which causes a low on output pin 10 of AND gate IC4-B, which low is applied over line 334 to pin 11 of ten-second counter IC1 so as to release the ten-second counter. Pins 3, 4 and 5 of counter IC1 will then apply highs to the input pins 1, 2 and 3 of AND gate IC3-C which causes pin 9 of AND gate IC3-A to apply a high over line 367 that resets flip-flop IC5-B through pin 10 of the flip-flop. As explained before, when flip-flop IC5-B is reset, the horn 346 is turned on and the solenoid 42 is de-energized allowing the door to open. This is the end of the cycle.

When the circuit is initially energized, it often takes 10 seconds to lock the lock 25 and put the circuit in a functioning mode. The system goes into automatic reset upon power failure or upon initial starting of the system. This reset mode has a 10-second time interval.

If the door 20 (see FIGS. 1–12) is pushed, the Hall-Effect switch 39 goes high putting a high on pins 1 and 2 of AND gate IC4-A which causes output pin 3 to go high, placing a high on lines 322 so as to release the twelve-bit counter IC2 causing a count to be entered from outside the clocking source. When three seconds is decoded by the ten-second counter IC1, the horn 346 will sound. If the door is released before the time delay of 15 or 30 seconds, whichever is selected, the Hall-Effect switch 39 will apply a low to pins 1 and 2 of AND gate IC4-A causing pin 3 to go high. When pin 3 goes high, a high is applied to line 322 which places a high on reset pin 11 of twelve-bit counter IC2. The count then ceases which, as explained before, cuts power to the horn 346 and resets the entire system. Consequently, nuisance situations are minimized by configuring the circuitry so that it responds only to a real effort to open the door. If one simply hits the panic bar, the horn 346 does not sound and the count does not start. The count starts only after a three-second interval. In accordance with this embodiment, if one releases the door after the three-second interval, then the count must start again.

(V) Circuitry for Multiple Door Security Using Reversible Mode Circuitry

Figure 18A:
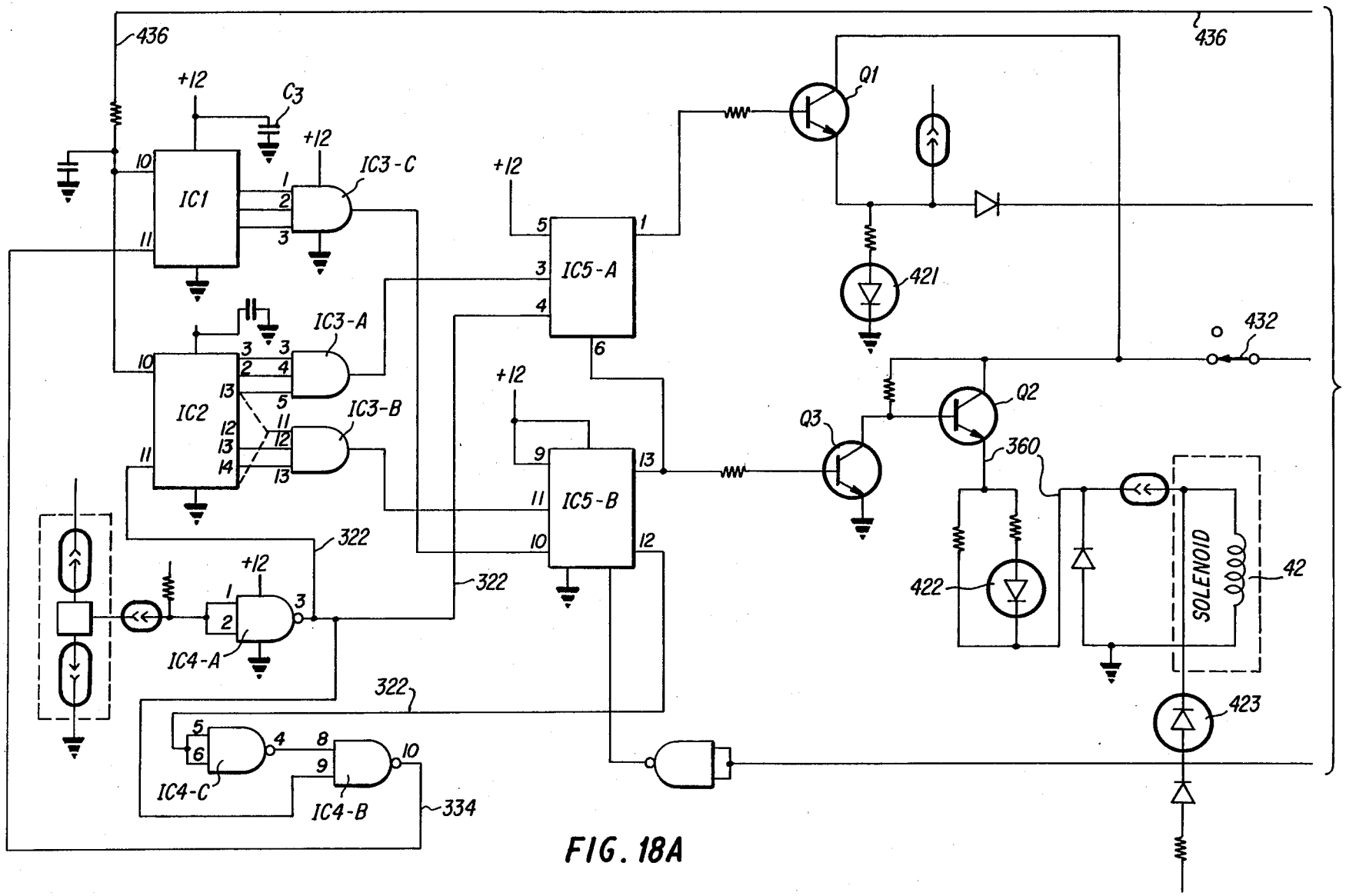
FIGS. 18A and 18B are circuit diagrams of a circuit having many of the components of FIGS. 17A and 17B but used to control a plurality of doors.
Figure 18B:
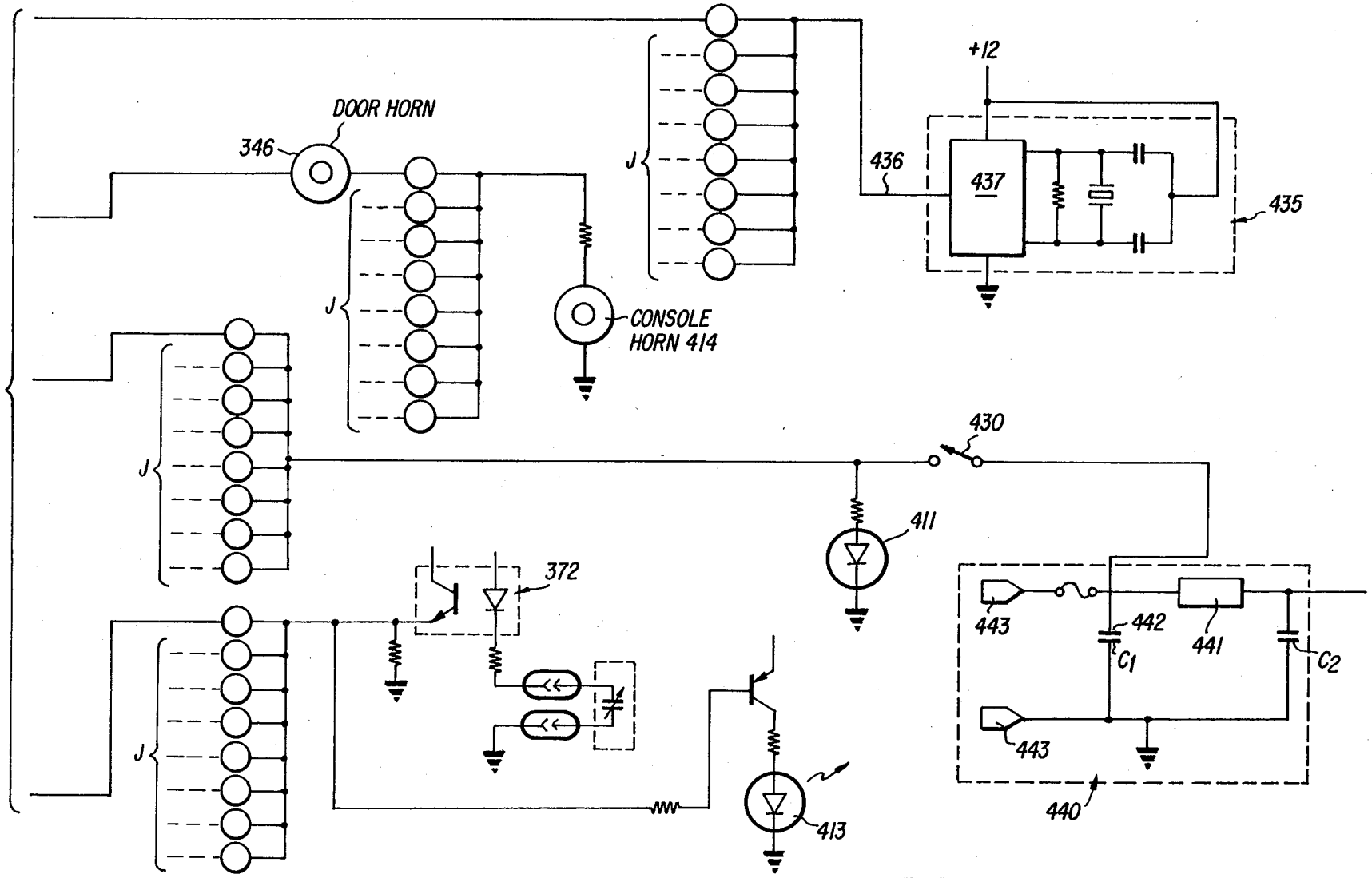
Figure 19:
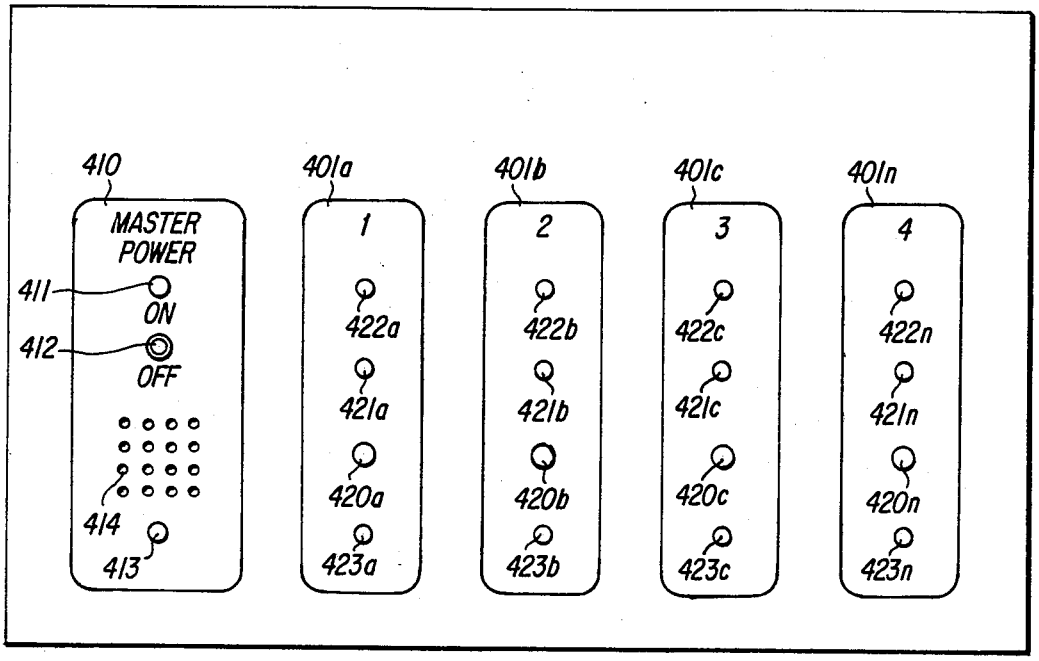
FIG. 19 is a planar view of a control panel for a plurality of doors.

Referring now more specifically to FIGS. 18A and 18B which discloses circuitry for a multiple door arrangement, the basic operation is essentially the same as with the circuit of FIGS. 17A and 17B. With the arrangement of FIGS. 18A and 18B, a plurality of doors 20 (connectors J for eight are shown) are controlled by a single master control panel such as that shown in FIG. 19. As is seen in FIG. 19, the master control panel includes a plurality of sections 401*a*–401*n* (four of which are shown) and a power section 410. The power section includes a light 411, an on-off switch 412 indicating whether or not the power is on or off, a fire alarm indicator light 413 and a audible alarm 414 which gives an audible alarm at the central station when an attempt is being made to open one of the doors in the array.

Each of the sections 401*a*–401*n* includes an on-off switch 420, a yellow LED 421, a green LED 422 and a red LED 423. The green LED 422 monitors the current to the solenoid 42 and remains lit as long as the solenoid is energized. Accordingly, the condition of the door can be monitored from the central station.

As is seen in FIG. 18A (which shows the circuitry for a single door), the green lamp 422 is inserted in line 360 between the solenoid 42 and power resistor Q2. When there is insufficient current flowing from the power transistor Q2 to the solenoid 42, the green lamp 422 will not be lit indicating that there is a problem at the door. The yellow trigger light LED 421 (FIG. 18A) becomes lit when someone has pressed the door for a period greater than three seconds. The yellow trigger light 421 is connected to the emitter of transistor Q1 and sounds at the same time that the horn 414 sounds, indicating that an attempt at egress is occurring. While the yellow trigger light 421 is lit and the horn 414 at the console is sounding, the horn 346 at the door also sounds notifying people in the vicinity of the door and the person trying to open the door that an attempt to open the door is occurring. When the door finally opens, the red LED 423 lights concurrently with lighting of yellow LED 421 and sounding of the horns 346 and 414.

When a fire alarm has been sounded to release all of the doors in the bank of doors, the light 413 in the power section 410 is turned on. If it is desired to release all of the doors simultaneously, a master switch 430 in the power section is thrown which extinguishes the green light of LED 411. In addition a switch 432 is associated with each individual section 401*a*–401*n* for releasing the doors individually.

In the multiple door system of FIGS. 18A and 18B, a clock circuit, designated generally by the numeral 435, is connected by a line 436 to pin 10 of IC2. The clock circuit 435 utilizes a semiconductor chip 437 (MM 5369) that has a square wave 60-Hz output which is applied instead of the 60-Hz input over line 301 utilized when just a single door is being secured with the system.

The input voltage to the power section is controlled by an input circuit 440 which changes a 28-volt DC input from jacks 443 to 12 volts which is applied to various points in the circuit of FIGS. 18A and 18B. In the embodiment disclosed, a 7812c terminal regulator 441 provides the 12-volt output at 1.5 amps. A 1000 microfared capacitor 442 is used to filter out irregular line current. By utilizing the input regulator, 12 volts can be supplied with a variation of approximately 10%.

Figure 20:
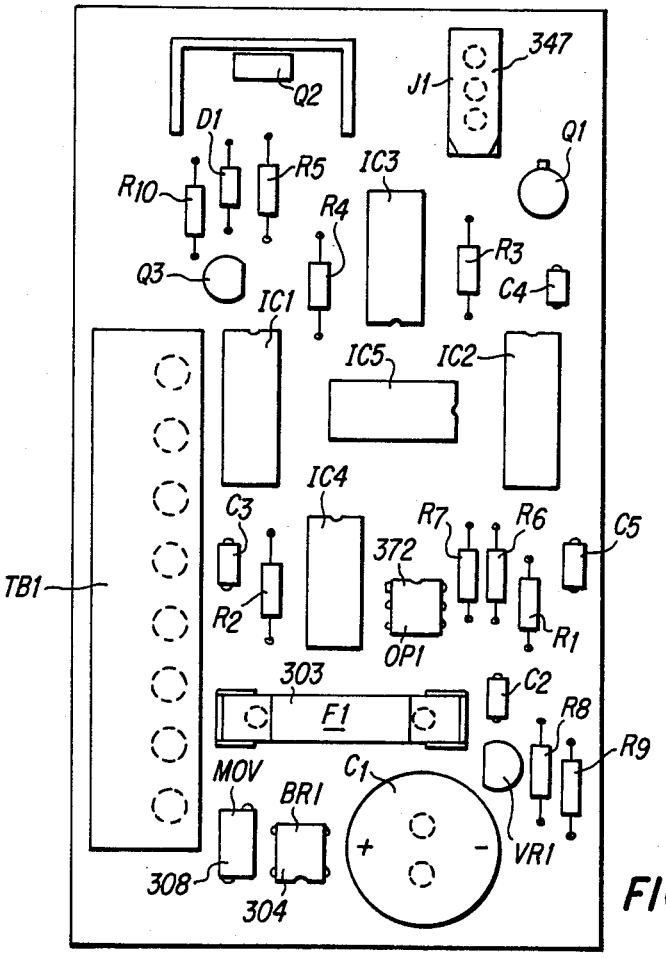
FIG. 20 is a top view of a circuit board mounting the various components shown in FIGS. 17A, 17B, 18A and 18B.

Referring now to FIG. 20, the following components are mounted on each circuit board to construct the circuitry of FIGS. 17A and 17B and to an extent FIG. 18A.

| Quantity | Part Number | Description |
|---|---|---|
| 1 | | Connector J1 |
| 1 | 4PCV08 | Terminal Strip, TB1 |
| 2 | 102071 | Fuse Holder |
| 1 | 312004 | Fuse, 3 Amp F1 |
| 1 | 6130-14 | Heat Sink |
| 1 | CN15C22OK | Capacitor, 20 PF C5 |
| 3 | CY20C104M | Capacitor, .1 UF-C2,C3,C4 |
| 1 | SM25T33OOMC | Capacitor, 3300 UF-C1 |
| 1 | 4N33 | Opto Isolator - OP1 |
| 1 | V68ZA2 | Metal Oxide Varistor - MOV |
| 1 | DL005 | Bridge Rectifier - BR1 |
| 1 | 78LO5CPL | Voltage Regulator - VR1 |
| 1 | MPSA05 | Transistor Q3 |
| 1 | T1P120 | Transistor Q2 |
| 1 | 2N2222A | Transistor Q1 |
| 1 | 1N4005 | Diode D1 |
| 1 | 4013 | Flip-Flop IC5 |
| 1 | 4093 | Quad Input IC4 |
| 1 | 4073 | 3 Input AND Gate - IC3 |
| 2 | 4040BE | 12-Bit Counter - IC1,IC2 |
| 1 | | Resistor, 68K-R10 |
| 3 | | Resistor, IK-R5,R6,R7 |
| 3 | | Resistor, 1OK-R3,R4,R9 |
| 2 | | Resistor, 2.2K-R2,R8 |
| 1 | | Resistor, 27K-R1 |
| 1 | D094-050 | Printed Wiring Bd. |

(VI) Summary of Disclosure-Reversible Mode

With respect to the single door system disclosed in FIGS. 17A and 17B in conjunction with the structure of FIGS. 1–16, the following sequence of events occurs:

| Elasped Time | Action Sequence |
|---|---|
| (1) 0 seconds | panic bar 24 pushed |
| (2) 3 seconds | local alarm 126 (FIG. 13) and 346 (FIG. 17B) sounds |
| (3) 15–30 seconds | bolt 33 releases keeper 29 (see FIGS. 2–13) |

(4) Loss of power at any time results in immediate unlatching of the security device.

(5) Activation of a central alarm 104 or smoke detector 105 results in immediate unlatching of the security device 25

(6) In the event that all other emergency overrides fail, the independent and redundant hydraulic override system allows the door 20 to open eventually when an opening force is applied to the door.

With respect to the multiple door system of FIGS. 18A, 18B and 19 in conjunction with the structure of FIGS. 1–16 and the panel of FIG. 19, the following sequence of events occurs:

| Elapsed Time | Action Sequence |
|---|---|
| (1) 0 seconds | panic bar 24 is pushed; central station green power lights 411 and green light 422 are on |
| (2) 3 seconds | local alert 346 sounded; central station alert activated; central station yellow trigger light 421 comes on; central station green light 422 stays on. |
| (3) 15 or 30 seconds | latch bolt 33 releases keeper 29, door opens; central station alert continues; local alert 346 continues; central station green secure light 422 turned off; central station yellow trigger light 421 remains on red central station unlocked light 423 is on. |
| (4) 25 & 40 seconds (depending on setting of time 3) | system resets and central station green secure light 422 is turned on; local 346 and central station alerts are turned off; central station red unlocked light 423 and yellow light 421 are turned off. |

(5) Loss of power at any time results in immediate unlatching of the security device 25.

(6) Activation of a central alarm system, such as smoke, heat or fire alarms or a sprinkler, results in immediate unlatching of the security device 25.

(7) In the event that all other emergency overrides fail, the independent and redundant hydraulic override system allows the door 20 to open eventually when an opening force is applied to the door.

(VII) Detailed Disclosure of Irreversible Mode Control Circuits

Figure 21A:
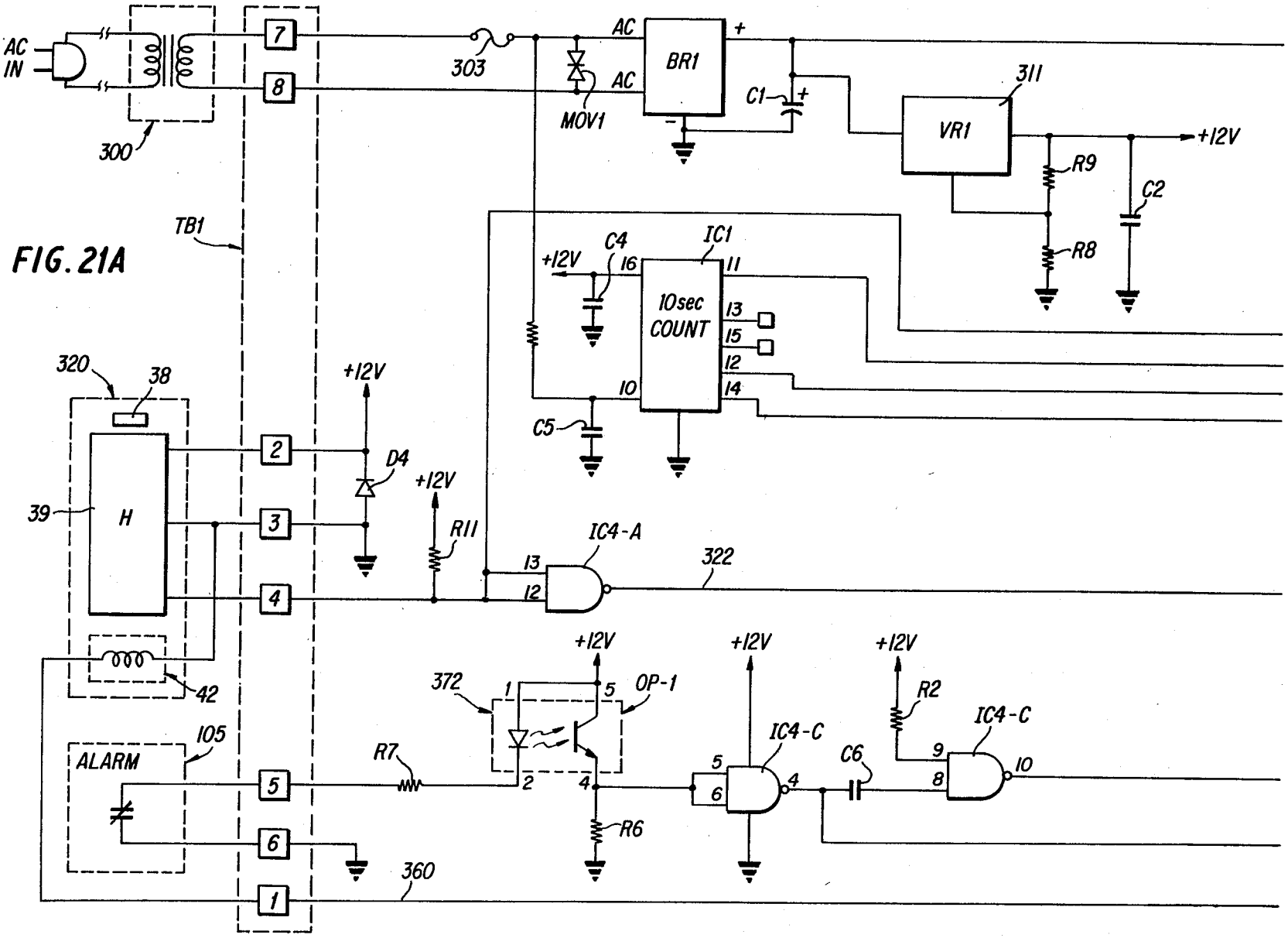
FIGS. 21H and 21B are circuit diagrams of a single circuit showing the details of another embodiment of the circuitry shown generally in FIG. 13 wherein the system operates in an irreversible mode.
Figure 21B:
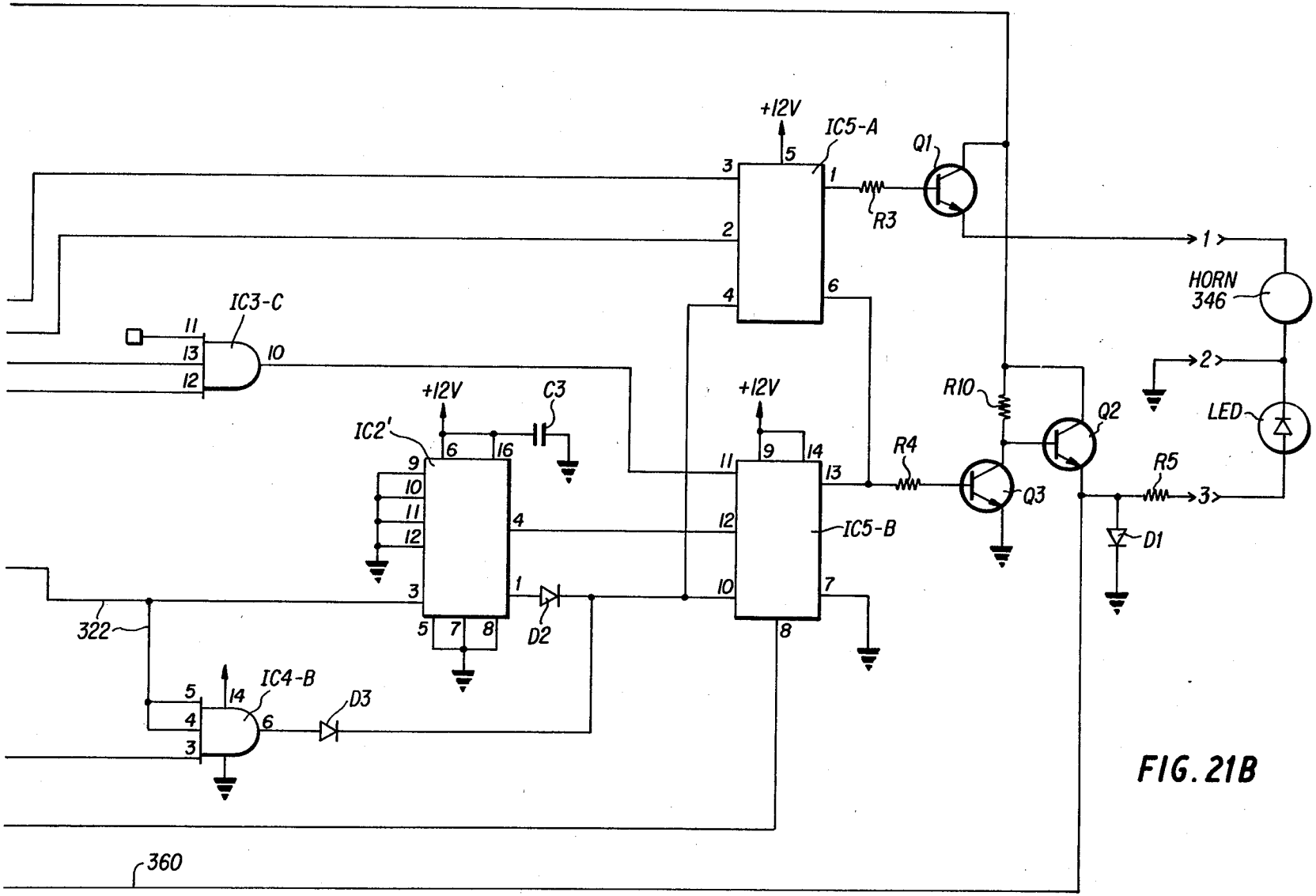

Referring now to the circuitry shown in FIGS. 21A and 21B, an irreversible mode of operation is disclosed wherein once one attempts to open the door 20 by applying pressure to the door, the counter IC1 begins counting the fifteen or thirty-second delay without an initial running of a three-second, nuisance time interval.

The circuit of FIGS. 21A and 21B is substantially similar to the circuit of FIGS. 17A and 17B which is used for the reversible mode with similar components having similar but primed reference numerals. As is readily seen, the primary distinction between the circuit disclosed in FIGS. 21A and 21B and that disclosed in FIGS. 17A and 17B is that the AND gates IC3-A and IC3-B are deleted from the circuit of FIGS. 21A and 21B. Moreover, there is no connection from the output pin of IC4-A to the reset pin 11' of IC1' which reset would cause the count of IC2' to terminate upon a high being placed on line 322'. Furthermore, in the circuit of FIGS. 21A and 21B, the output from IC4-A is applied directly to the clock pin 3 of IC2' to immediately start the count instead of being applied through IC1' to first initiate a nuisance interval. Consequently, when one pushes on the door 20, the fifteen or thirty-second time interval starts immediately and continues to run even if pressure on the door ceases during the fifteen or thirty-second time interval. At the end of the fifteen or thirty-second time interval, the door 20 will unlock allowing egress if the door is pushed.

In accordance with the disclosed embodiment of the irreversible mode, IC1′ does not function as a ten-second counter to relock the door 20 on the expiration of a ten-second time interval after the door has been unlocked. Rather, the door 20 remains unlocked until it is opened and shut, at which time the solenoid 42 is immediately relocked and the horn 346 ceases sounding.

Figure 22:
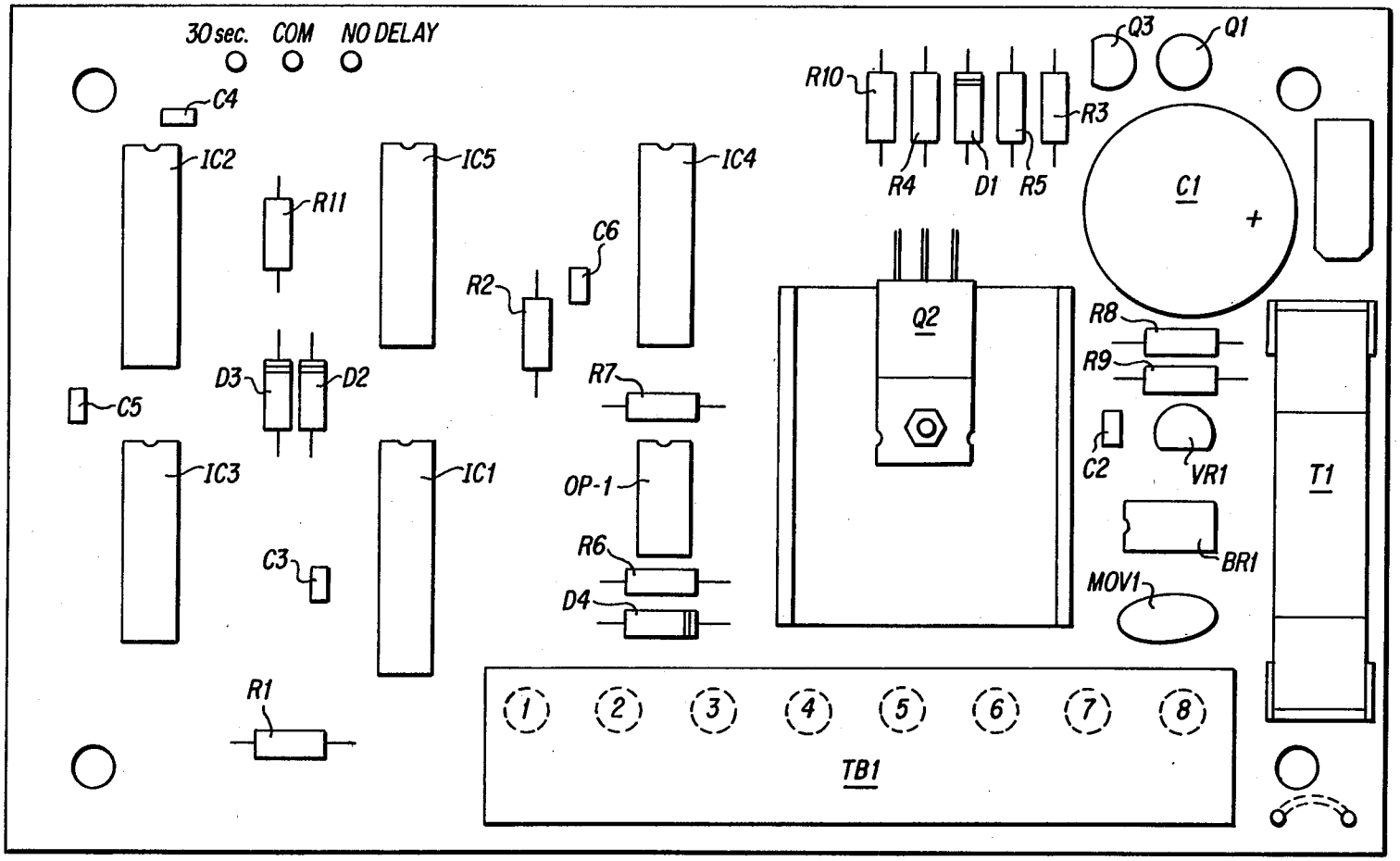
FIG. 22 is a top view of a circuit board mounting the various components shown in FIGS. 21A and 21B.

Referring now to FIG. 22, the following components are mounted on each circuit board to construct the circuitry of FIGS. 21A and 21B.

COMPONENTS FOR IRREVERSIBLE MODE CIRCUITRY

| Qty | Part Number | Description | Source |
|---|---|---|---|
| 1 | 6130-14 | Heat Sink | Thermalloy |
| 1 | 1625-31 | | |
| | 03-06-1032 | Connector J1 | Molex |
| 3 | 02-06-7103 | Pin, Solder Tail | Molex |
| 1 | 4PCVO8 | Terminal Strip TB1 | Reed Devices |
| 1 | 102071 | Fuse Holder | Littlefuse |
| 1 | 312004 | Fuse, 3-amp F1 | Littlefuse |
| 1 | V68AZ02 | Metal Oxide Varistor MOV1 | General Elec. |
| 1 | MPSA05 | Transistor Q3 | Texas Instr. |
| 1 | TIP120 | Transistor Q2 | Texas Instr. |
| 1 | 2N2222A | Transistor Q1 | SGS Ates |
| 1 | 78LO5CPL | Voltage Regulator VR1 | Texas Instr. |
| 1 | DL005 | Bridge Rectifier BR1 | General Inst. |
| 4 | 1N4005 | Diode D1,D2,D3,D4 | General Inst. |
| 1 | 4N33 | Opto-Isolator OP-1 | TRW Optron |
| 1 | 4013 | Dual Flip-Flop IC5 | SGS Ates |
| 1 | 4093 | 2-Input Nand Gates IC4 | SGS Ates |
| 1 | 4073 | 3-Input and Gates IC3 | SGS Ates |
| 2 | 4040BE | 12-Bit Counter IC1,IC2 | SGS Ates |
| 1 | CN15C22OK | Capacitor, 20 pf C5 | Centralab |
| 4 | CY20C104M | Capacitor, 0.1 uf C2,C3,C4,C6 | Centralab |
| 1 | SM25T3300MC | Capacitor, 3300 uf C1 | United Chemi-Con |
| 1 | RC07GF683J | Resistor, 68K R10 | ECI |
| 2 | RC07GF222J | Resistor, 2.2K R8,R11 | ROHM |
| 3 | RC07GF102J | Resistor, 1K R5,R6,R7 | Speer Elec. |
| 4 | RC07GF103J | Resistor, 10K R2,R3,R4,R9 | Speer Elec. |
| 1 | RC07GF273J | Resistor, 27K R1 | Speer Elec. |
| 1 | C094-050-01 | Printed Wiring Board | |

(VIII) Summary of Disclosure of Irreversible Mode

With respect to the single door control system disclosed in FIGS. 21A and 21B in conjunction with the structure of FIGS. 1–16, the following sequence of events occurs:

| Elapsed Time | Action Sequence |
|---|---|
| (1) 0 seconds | panic bar 24 pushed, local alarm 126 (FIG. 13), 346 (FIG. 21B) sounds |
| (2) 15/30 seconds | bolt 33 releases keeper 29 (see FIGS. 2–13) local alarm 126 (FIG. 13), 346 (FIG. 21B) continues to sound until door 20 is opened and returned to the closed position. |
| (3) 15/30 seconds | door is immediately relocked upon closing and local alarm 126 (FIG. 13), 346′ (FIG. 21B) is turned off. |

-continued (4) Loss of power at any time results in immediate unlatching of the security device 25.

(5) Activation of a central alarm 104 or smoke detector 105 results in immediate unlatching of the security device 25.

(6) In the event that all other emergency overrides fail, the independent and redundant hydraulic override system allows the door 20 to open when an opening force is applied to the door.

(7) With irreversible system, once the system is activated by pressing the panic bar 24 to move the door 20 so as to trip the Hall-Effect switch 39, continuous pressure on the door or panic bar is not required.

While FIGS. 21A and 21B disclose the circuitry of a single door system operating in an irreversible mode, it is well within the skill of one skilled in the art to utilize the circuitry of FIGS. 21A and 21B with a multiple door system by using the approach of FIGS. 18A and 18B in conjunction with a control panel such as that of FIG. 19. In a multiple door system operating in an irreversible mode, the folowing sequence of events occurs:

| Elapsed Time | Action Sequence |
|---|---|
| (1) 0 seconds | panic bar 24 is pushed; local maker 346 (FIG. 21B) is activated, central station audio is sounded, central station yellow trigger light 421 comes on. |
| (2) 15–30 seconds | latch bolt 33 releases keeper 29; door 20 available for egress; central station alert continues, local alert 346 continues; central station green secure light 422 is turned off; central station yellow trigger light 421 remains on; central station red light indicating unlocked condition comes on. |
| (3) 15+–30+ seconds | delay apparatus, 25 relocks door 20 immediately upon closing; central station and local alerts 346 stop sounding, central station green secure light is turned on; central station yellow trigger light 421 is turned off, and central station red unlocked light is turned off. |

(4) Loss of power at any time results in immediate unlatching of the security device 25.

(5) Activation of a central alarm 104 or smoke detector 105 results in immediate unlatching of the security device 25. p (6) In the event that all other emergency overrides fail, the independent and redundant hydraulic override system allows the door 20 to open when an opening force is applied to the door.

(7) With irreversible system, once the system is activated by pressing the panic bar 24 to move the door 20 so as to trip the Hall-Effect switch 39, continuous pressure on the door or panic bar is not required.

(IX) Controlling and Monitoring Multiple Banks of Doors

Figure 23:
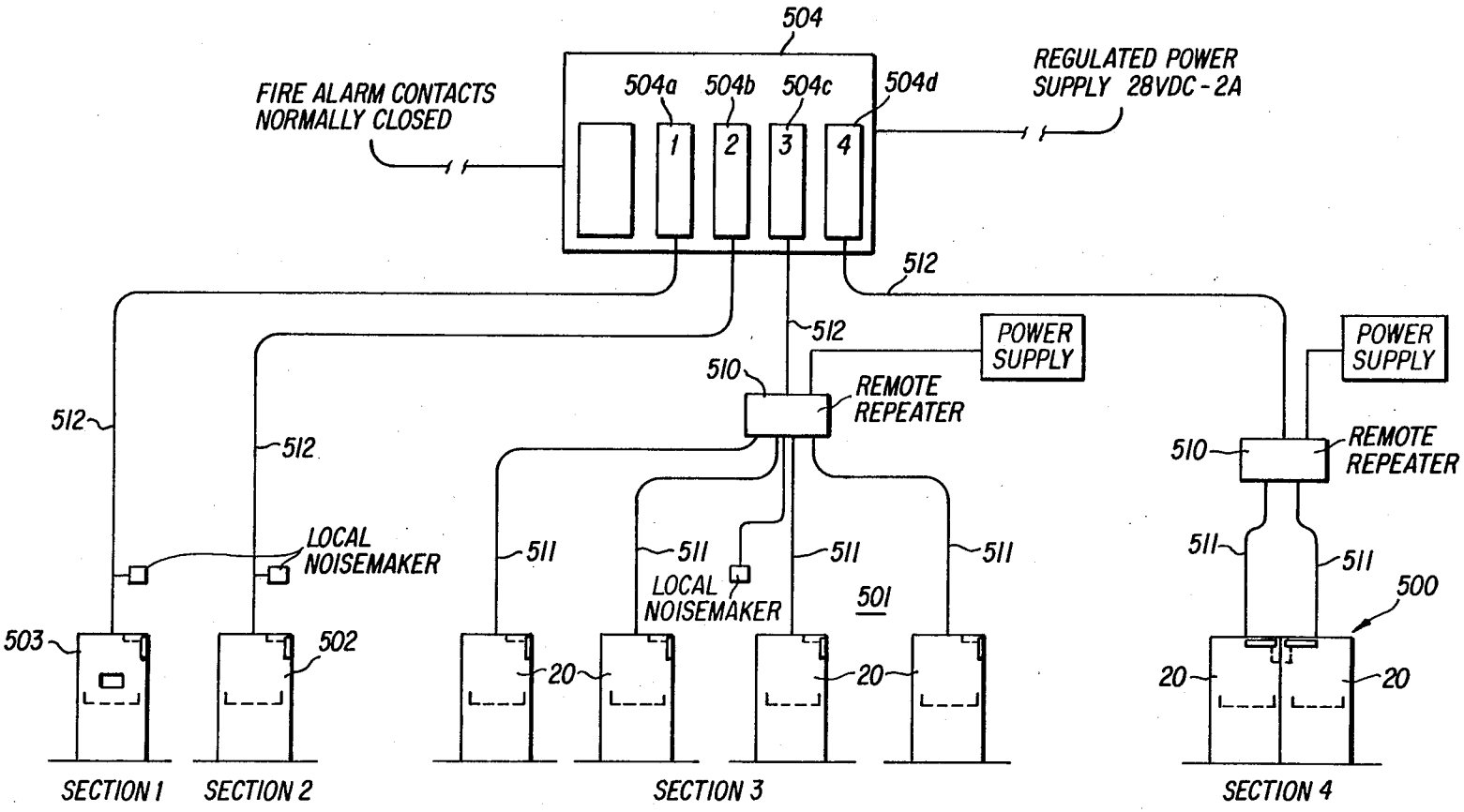
FIG. 23 is a schematic diagram showing a plurality of doors arranged in zones or sections with each door protected by a delay device configured in accordance with the principles of the instant invention.

Referring now to FIG. 23, multiple banks 500 and 501 of doors 20 as well as single doors 502 and 503 are shown being controlled via a single master control panel 504, which panel is preferably configured similar to the control panel shown in FIG. 19. However, instead of necessarily controlling a single door 20 with each of the sections **504*a*–504*n* (four sections are shown), as is done in FIG. 19, each section can control either a single bank of doors (500 and 501) or a single door (503 and 502). In order to control a bank of doors such as the banks 500 and 501, each door in the bank is connected to a remote repeater 510 by a line 511. The remote repeaters 510 are then connected to the control panel 504 via single lines 512, as are the single doors 502 and 503. In this way egress from an entire building may be monitored and controlled in a rational manner without having huge bundles of wires going back to the master panel 504**.

The aforedescribed examples and embodiments are illustrative of various forms that the invention may assume, and the invention is limited only by the following claims.

What we claim is:

1. In a security device for securing a closure member to a frame member, the security device comprising:

bolt mounting means on one member, bolt means within the bolt mounting means for movement between a latched and an unlatched position;

keeper means having a projecting strike portion which strike portion engages with the bolt means to latch the closure, the keeper means further including a mounting portion wherein the mounting portion of the keeper is a resilient shank having one end free and having the strike portion at the other end, and wherein the means for loosely securing the mounting means includes a first bracket loosely fitting over the shank between the free end and strike portion, allowing the shank to move laterally within the bracket, and a second bracket engaging the shank adjacent the free end thereof, and keeper guide means mounted adjacent the bolt, the keeper guide means including an inner opening aligned with the bolt and corresponding in crosssection to the strike portion of the keeper and further including beveled surface means diverging from the inner opening toward an outer opening larger than the inner opening, wherein the strike portion of the keeper is channeled by the keeper guide means through the inner opening into latching engagement with the bolt upon closing the closure member with respect to the frame member, whereby any misalignment between the keeper and the bolt is compensated for by the loose mounting of the keeper and the beveled guide surface means.

2. The security device of claim 1 further including a pin-in-slot connection between the shank and second bracket for allowing longitudinal movement of the shank relative to the bracket.

3. In a security device for securing a closure member to a frame member, the security device comprising:

housing means on one member, said housing means having an opening through a wall thereof;

bolt means mounted entirely within the housing means for movement between a latched and an unlatched position adjacent the opening in the housing;

keeper means having a projecting strike portion which strike portion passes through the opening in the housing and engages with the bolt means to latch the closure; the keeper means further including a mounting portion and means for loosely securing the mounting portion to the other member, whereby the keeper is free to move in two dimensions with respect to the other member and with respect to the opening in the housing;

keeper guide means fixed on the housing in spaced relation to the bolt and aligned with the opening through the housing; the keeper guide means including an inner opening aligned with the bolt and corresponding in crosssection to the strike portion of the keeper, the guide means further including beveled surface means surrounding the inner opening and diverging from the inner opening toward an outer opening larger than the inner opening, wherein the strike portion of the keeper is channeled by the keeper guide means through the inner opening into latching engagement with the bolt upon closing the closure member with respect to the frame member, whereby any misalignment between the keeper and the bolt is compensated for by the loose mounting of the keeper and the beveled guide surface means properly positions the loose keeper with respect to the bolt.

4. The security device of claim 1 wherein the mounting portion of the keeper is a resilient shank having one end free and having a strike portion at the other end, and wherein the means for loosely securing the mounting means includes a first bracket loosely fitting over the shank between the free end and strike portion, allowing the shank to move laterally within the bracket, and a second bracket engaging the shank adjacent the free end thereof.

5. The security device of claim 4 further including a pin-in-slot connection between the shank and second bracket for allowing longitudinal movement of the shank relative to the bracket.

* * * * *